US012325832B2

(12) United States Patent
Koseoglu et al.

(10) Patent No.: US 12,325,832 B2
(45) Date of Patent: Jun. 10, 2025

(54) METHOD OF PRODUCING PYROLYSIS PRODUCTS FROM A MIXED PLASTICS STREAM AND INTEGRATION OF THE SAME IN A REFINERY

(71) Applicant: Saudi Arabian Oil Company, Dhahran (SA)

(72) Inventors: Omer Refa Koseoglu, Dhahran (SA); Gerard De Nazelle, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/355,718

(22) Filed: Jun. 23, 2021

(65) Prior Publication Data

US 2023/0013013 A1 Jan. 19, 2023

(51) Int. Cl.
*C10G 65/06* (2006.01)
*C10G 1/10* (2006.01)
(Continued)

(52) U.S. Cl.
CPC ..... *C10G 65/16* (2013.01); *C10G 1/10* (2013.01); *C10G 7/06* (2013.01); *C10G 35/00* (2013.01);
(Continued)

(58) Field of Classification Search
CPC ..... C10G 65/16; C10G 65/06; C10G 1/10; C10G 7/06; C10G 35/00; C10G 45/08;
(Continued)

(56) References Cited

U.S. PATENT DOCUMENTS 3,074,878 A 1/1963 Pappas
3,492,220 A * 1/1970 Schwarzenbek ..... C10G 45/36 208/210
(Continued)

FOREIGN PATENT DOCUMENTS

FR 3054558 A1 * 2/2018
KR 102004522 B1 7/2019
WO 2021201932 A1 10/2021

OTHER PUBLICATIONS

Notification of Transmittal of the International Search Report and Written Opinion of the International Searching Authority, or the Declaration dated Feb. 22, 2023 pertaining to International application No. PCT/US2022/049245 filed Nov. 8, 2022, pp. 1-13.

*Primary Examiner* — Michelle Stein
(74) *Attorney, Agent, or Firm* — DINSMORE & SHOHL LLP

(57) ABSTRACT

Method of producing pyrolysis products from mixed plastics along with an associated system for processing mixed plastics. The method includes conducting pyrolysis of a plastic feedstock to produce plastic pyrolysis oil; feeding the plastic pyrolysis oil to a first fractionator to separate the plastic pyrolysis oil into a distillate fraction including naphtha and diesel and a vacuum gas oil fraction; and feeding the distillate fraction to a three step hydrotreating operation. The three step hydrotreating operation includes feeding the distillate fraction to a first hydrotreating unit to remove di-olefins to produce a first product stream, feeding the first product stream to a second hydrotreating unit to remove mono-olefins to produce a second product stream; and feeding the second product stream to a third hydrotreating unit to remove sulfur and nitrogen by hydrodesulfurization and hydrodenitrogenation to produce a third product stream. Such system may be integrated with a conventional refinery.

19 Claims, 5 Drawing Sheets

(51) Int. Cl.

| | |
|---|---|
| ***C10G 7/06*** | (2006.01) |
| ***C10G 35/00*** | (2006.01) |
| ***C10G 45/08*** | (2006.01) |
| ***C10G 45/36*** | (2006.01) |
| ***C10G 65/16*** | (2006.01) |

(52) U.S. Cl.
CPC ..... *C10G 45/08* (2013.01); *C10G 45/36* (2013.01); *C10G 65/06* (2013.01); *C10G 2300/1003* (2013.01); *C10G 2300/301* (2013.01); *C10G 2300/4006* (2013.01); *C10G 2300/4056* (2013.01); *C10G 2400/04* (2013.01); *C10G 2400/06* (2013.01); *C10G 2400/30* (2013.01)

(58) Field of Classification Search
CPC ..... C10G 45/36; C10G 2300/1003; C10G 2300/301; C10G 2300/4006; C10G 2300/4056; C10G 2400/04; C10G 2400/06; C10G 2400/30; C10G 69/06
See application file for complete search history.

(56) References Cited

U.S. PATENT DOCUMENTS 3,494,859 A * 2/1970 Parker ..... C10G 65/06 585/273
3,595,780 A * 7/1971 Adams ..... C10G 65/06 208/217
3,758,403 A 9/1973 Rosinski et al.
3,894,931 A 7/1975 Nace et al.
3,894,933 A 7/1975 Owen et al.
3,894,934 A 7/1975 Owen et al.
3,960,978 A 6/1976 Givens et al.
4,419,221 A 12/1983 Castagnos, Jr. et al.
4,980,053 A 12/1990 Li et al.
5,216,149 A 6/1993 Evans et al.
5,300,704 A 4/1994 Evans et al.
5,321,174 A 6/1994 Evans et al.
5,326,465 A 7/1994 Yongqing et al.
5,359,061 A 10/1994 Evans et al.
5,359,099 A 10/1994 Evans et al.
5,386,070 A 1/1995 Evans et al.
5,462,652 A 10/1995 Wegerer
5,464,602 A 11/1995 Evans et al.
5,821,553 A 10/1998 Evans et al.
5,904,838 A * 5/1999 Kalnes ..... C10G 65/04 208/143
6,143,940 A * 11/2000 Miller ..... C10G 1/10 208/69
6,444,118 B1 * 9/2002 Podrebarac ..... C10G 45/00 208/143
6,656,346 B2 12/2003 Ino et al.
6,822,126 B2 11/2004 Miller
8,277,643 B2 10/2012 Huber et al.
8,864,984 B2 10/2014 Huber et al.
9,169,442 B2 10/2015 Huber et al.
9,428,695 B2 8/2016 Narayanaswamy et al.
9,447,332 B2 9/2016 Narayanaswamy et al.
9,453,166 B2 9/2016 Huber et al.
9,458,394 B2 10/2016 Dean et al.
9,896,627 B2 2/2018 Koseoglu
10,308,896 B2 6/2019 Scheibel et al.
10,442,997 B2 10/2019 Narayanaswamy et al.
10,858,593 B2 12/2020 Ramamurthy et al.
10,975,313 B2 4/2021 Ramamurthy et al.
2003/0042175 A1 * 3/2003 Debuisschert ..... C10G 65/06 208/204
2003/0199717 A1 * 10/2003 Miller ..... C10G 45/64 208/67
2003/0199718 A1 10/2003 Miller
2009/0151233 A1 * 6/2009 Miller ..... C10G 1/10 44/307
2012/0108866 A1 * 5/2012 Grenoble ..... C10G 69/06 585/259
2012/0273394 A1 * 11/2012 Banerjee ..... C10G 45/38 208/264
2016/0362609 A1 * 12/2016 Ward ..... C10G 69/02
2017/0101592 A1 * 4/2017 Green ..... C10L 1/1616
2018/0002609 A1 * 1/2018 Narayanaswamy ..... C10G 1/02
2018/0023010 A1 * 1/2018 Leflaive ..... B01J 37/0201 585/260
2018/0155638 A1 * 6/2018 Al-Ghamdi ..... C10G 69/00
2019/0153338 A1 * 5/2019 Charra ..... C10G 65/06
2020/0017773 A1 1/2020 Ramamurthy et al.
2021/0189250 A1 6/2021 Timken

* cited by examiner

METHOD OF PRODUCING PYROLYSIS PRODUCTS FROM A MIXED PLASTICS STREAM AND INTEGRATION OF THE SAME IN A REFINERY

TECHNICAL FIELD

The present disclosure relates to method of producing pyrolysis products from a mixed plastics stream. In particular, certain embodiments of the disclosure relate to methods to prepare the products of plastic pyrolysis as feedstock for fuel and chemical refining process through a specialized three step hydrotreating operation.

BACKGROUND

Plastic is a synthetic or semisynthetic organic polymer composed of mainly carbon and hydrogen. Further, plastics tend to be durable, with a slow rate of degradation, therefore they stay in the environment for a long time and are not prone to rapid breakdown upon disposal. Pure plastics are generally insoluble in water and nontoxic. However, additives used in plastic preparation are toxic and may leach into the environment. Examples of toxic additives include phthalates. Other typical additives include fillers, colorant, plasticizers, stabilizers, anti-oxidants, flame retardants, ultraviolet (UV) light absorbers, antistatic agents, blowing agents, lubricants used during its preparation to change its composition and properties.

Plastics pyrolyze at high temperatures and polymers can be converted back to their original monomer as gas or liquid and can be recovered. However, the additives added to the plastic during production present challenges in effectively utilizing the recovered products prom pyrolysis. Upon pyrolysis, the additives end-up in the pyrolysis products.

SUMMARY

Accordingly, there is a clear and long-standing need to provide a solution to utilize the pyrolysis products generated from the pyrolysis of plastics. To utilize such pyrolysis products the residue left from the additives in the pyrolysis product must be removed.

In accordance with one or more embodiments of the present disclosure, a method of producing pyrolysis products from a mixed plastics stream is disclosed. The method includes (a) conducting pyrolysis of a plastic feedstock to produce a stream of plastic pyrolysis oil; (b) feeding the plastic pyrolysis oil to a first fractionator to separate the plastic pyrolysis oil into a distillate fraction including naphtha and diesel boiling in the range of 36 to 370° C. and a vacuum gas oil fraction comprising hydrocarbons boiling above 370° C.; and (c) feeding the distillate fraction to a three step hydrotreating operation. The three step hydrotreating operation includes (i) feeding the distillate fraction to a first hydrotreating unit configured and operated to remove di-olefins by hydrogenation from the distillate fraction to produce a first product stream of dediolefinized plastic pyrolysis distillate; (ii) feeding the first product stream to a second hydrotreating unit configured and operated to remove mono-olefins by hydrogenation from the first product stream to produce a second product stream of deolefinized plastic pyrolysis distillate; and (iii) feeding the second product stream to a third hydrotreating unit configured and operated to remove sulfur by hydrodesulfurization and nitrogen by hydrodenitrogenation from the second product stream to produce a third product stream of clean plastic pyrolysis distillate.

In some embodiments, the first fractionator further separates the distillate fraction into a plastic pyrolysis distillate naphtha stream and a plastic pyrolysis distillate diesel stream. Further, the first hydrotreating unit is split into a first naphtha hydrotreating unit and a first diesel hydrotreating unit, the second hydrotreating unit is split into a second naphtha hydrotreating unit and a second diesel hydrotreating unit, and the third hydrotreating unit is split into a third naphtha hydrotreating unit and a third diesel hydrotreating unit such that the three step hydrotreating operation is split into a plastic pyrolysis distillate naphtha hydrotreating operation and a plastic pyrolysis distillate diesel hydrotreating operation. The plastic pyrolysis distillate naphtha hydrotreating operation includes (i) feeding the plastic pyrolysis distillate naphtha stream to the first naphtha hydrotreating unit configured and operated to remove di-olefins by hydrogenation from the plastic pyrolysis distillate naphtha stream to produce a first naphtha product stream of dediolefinized plastic pyrolysis distillate naphtha; (ii) feeding the first naphtha product stream to the second naphtha hydrotreating unit configured and operated to remove mono-olefins by hydrogenation from the first naphtha product stream to produce a second naphtha product stream of deolefinized plastic pyrolysis distillate naphtha; and (iii) feeding the second naphtha product stream to the third naphtha hydrotreating unit configured and operated to remove sulfur by hydrodesulfurization and nitrogen by hydrodenitrogenation from the second naphtha product stream to produce a third naphtha product stream of clean plastic pyrolysis distillate naphtha. The plastic pyrolysis distillate diesel hydrotreating operation includes (i) feeding the plastic pyrolysis distillate diesel fraction to the first diesel hydrotreating unit configured and operated to remove di-olefins by hydrogenation from the plastic pyrolysis distillate diesel stream to produce a first diesel product stream of dediolefinized plastic pyrolysis distillate diesel; (ii) feeding the first diesel product stream to the second hydrotreating unit configured and operated to remove mono-olefins by hydrogenation from the first diesel product stream to produce a second diesel product stream of deolefinized plastic pyrolysis distillate diesel; and (iii) feeding the second diesel product stream to the third diesel hydrotreating unit configured and operated to remove sulfur by hydrodesulfurization and nitrogen by hydrodenitrogenation from the second diesel product stream to produce a third diesel product stream of clean plastic pyrolysis distillate diesel.

In some embodiments, the method further includes integration with a conventional refinery such that the hydrotreated plastic pyrolysis naphtha stream is directly provided to an aromatic recovery unit, the hydrotreated plastic pyrolysis diesel stream is combined with a diesel output stream from the conventional refinery, or the hydrotreated plastic pyrolysis naphtha stream is directly provided to an aromatic recovery unit and the hydrotreated plastic pyrolysis diesel stream is combined with a diesel output stream from the conventional refinery.

In accordance with one or more embodiments of the present disclosure, a system for processing mixed plastics into plastic pyrolysis products. The system includes an inlet stream comprising mixed plastics; a plastic pyrolysis unit, the plastic pyrolysis unit in fluid communication with the inlet stream, and operable generate a stream of plastic pyrolysis oil from the inlet stream; a first fractionator, the first fractionator in fluid communication with the plastic pyrolysis unit and operable to separate the stream of plastic pyrolysis oil into a distillate fraction including naphtha and diesel boiling in the range of 36 to 370° C. and a vacuum gas oil fraction comprising hydrocarbons boiling above 370° C.; a first hydrotreating unit, the first hydrotreating unit in fluid communication with the first fractionator and operable to remove di-olefins by hydrogenation from the distillate fraction provided from the first fractionator to produce a first product stream of dediolefinized plastic pyrolysis distillate; a second hydrotreating unit, the second hydrotreating unit in fluid communication with the first hydrotreating unit and operable to remove mono-olefins by hydrogenation from the first product stream provided from the first hydrotreating unit to produce a second product stream of deolefinized plastic pyrolysis distillate; and a third hydrotreating unit, the third hydrotreating unit in fluid communication with the second hydrotreating unit and operable to remove sulfur by hydrodesulfurization and nitrogen by hydrodenitrogenation from the second product stream provided from the second hydrotreating unit to produce a third product stream of clean plastic pyrolysis distillate.

In some embodiments, the first hydrotreating unit is split into a first naphtha hydrotreating unit and a first diesel hydrotreating unit, the second hydrotreating unit is split into a second naphtha hydrotreating unit and a second diesel hydrotreating unit, and the third hydrotreating unit is split into a third naphtha hydrotreating unit and a third diesel hydrotreating unit, where the first naphtha hydrotreating unit is in fluid communication with the first fractionator and operable to remove di-olefins by hydrogenation from the plastic pyrolysis distillate naphtha stream provided from the first fractionator to produce a first naphtha product stream of dediolefinized plastic pyrolysis distillate naphtha; the first diesel hydrotreating unit is in fluid communication with the first fractionator and operable to remove di-olefins by hydrogenation from the plastic pyrolysis distillate diesel stream provided from the first fractionator to produce a first diesel product stream of dediolefinized plastic pyrolysis distillate diesel; the second naphtha hydrotreating unit is in fluid communication with the first naphtha hydrotreating unit and operable to remove mono-olefins by hydrogenation from the first naphtha product stream provided from the first naphtha hydrotreating unit to produce a second naphtha product stream of deolefinized plastic pyrolysis distillate naphtha; the second diesel hydrotreating unit is in fluid communication with the first diesel hydrotreating unit and operable to remove di-olefins by hydrogenation from the first diesel product stream provided from the first diesel hydrotreating unit to produce a second diesel product stream of deolefinized plastic pyrolysis distillate diesel; the third naphtha hydrotreating unit is in fluid communication with the second naphtha hydrotreating unit and operable to remove sulfur by hydrodesulfurization and nitrogen by hydrodenitrogenation from the second naphtha product stream provided from the second naphtha hydrotreating unit to produce a third naphtha product stream of clean plastic pyrolysis distillate naphtha; and the third diesel hydrotreating unit is in fluid communication with the second diesel hydrotreating unit and operable to remove sulfur by hydrodesulfurization and nitrogen by hydrodenitrogenation from the second diesel product stream provided from the second diesel hydrotreating unit to produce a third diesel product stream of clean plastic pyrolysis distillate diesel.

Additional features and advantages of the described embodiments will be set forth in the detailed description that follows. The additional features and advantages of the described embodiments will be, in part, readily apparent to those skilled in the art from that description or recognized by practicing the described embodiments, including the detailed description that follows as well as the drawings and the claims.

BRIEF DESCRIPTION OF THE DRAWINGS

The following detailed description of specific embodiments of the present disclosure can be best understood when read in conjunction with the following drawings in which.

Reference will now be made in greater detail to various embodiments, some embodiments of which are illustrated in the accompanying drawings. Whenever possible, the same reference numerals will be used throughout the drawings to refer to the same or similar units.

DETAILED DESCRIPTION

Figure 1:
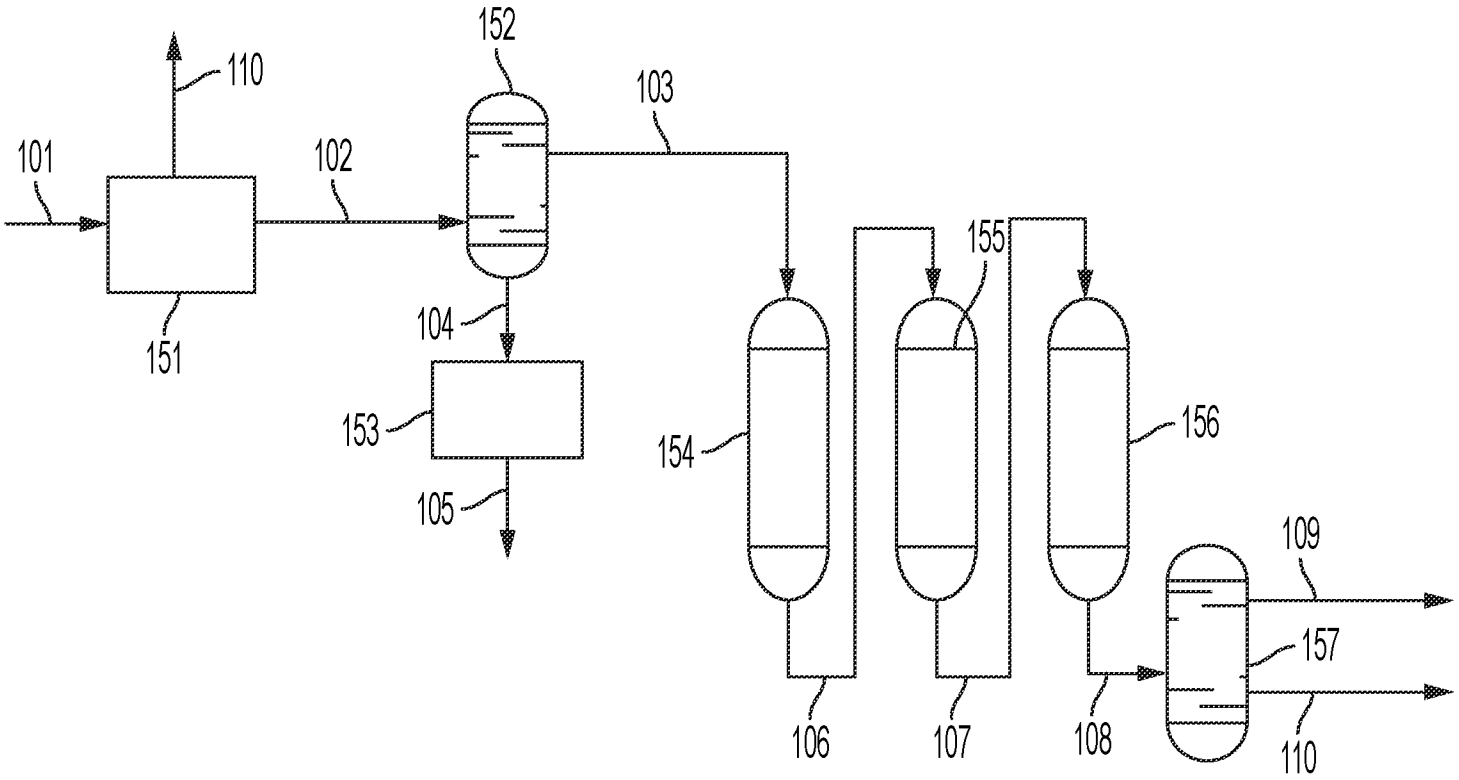
FIG. 1 is a schematic illustration of one or more embodiments of the present disclosure, in which a distillate fraction which include naphtha and diesel boiling in the range of 36 to 370° C. fractionated from plastic pyrolysis oil produced in the pyrolysis of a plastic feedstock is fed to a unitary three step hydrotreating operation.

Embodiments of systems and associated methods for producing pyrolysis products from a mixed plastics stream are provided in the present disclosure.

A system for processing mixed plastics into plastic pyrolysis products includes an inlet stream comprising mixed plastics, a plastic pyrolysis unit, a first fractionator, and a three part hydrotreating unit. The three part hydrotreating unit comprises a first hydrotreating unit, a second hydrotreating unit, and a third hydrotreating unit. The plastic pyrolysis unit is operable to generate a stream of plastic pyrolysis oil from the inlet stream. The first fractionator is operable to separate the stream of plastic pyrolysis oil into a distillate fraction including naphtha and diesel boiling and a vacuum gas oil fraction. Further, the first hydrotreating unit is operable to remove di-olefins from the distillate fraction to produce a first product stream, the second hydrotreating unit is operable to remove mono-olefins from the first product stream to produce a second product stream, and the third hydrotreating unit is operable to remove sulfur and nitrogen by hydrodesulfurization and hydrodenitrogenation from the second product stream to produce a third product stream.

A system for processing mixed plastics into plastic pyrolysis products may also include an arrangement where the first fractionator is further operable to separate the distillate fraction into a plastic pyrolysis distillate naphtha stream comprising hydrocarbons and a plastic pyrolysis distillate diesel stream. In such arrangement the first hydrotreating unit is split into a first naphtha hydrotreating unit and a first diesel hydrotreating unit, the second hydrotreating unit is split into a second naphtha hydrotreating unit and a second diesel hydrotreating unit, and the third hydrotreating unit is split into a third naphtha hydrotreating unit and a third diesel hydrotreating unit. The first naphtha hydrotreating unit, the second naphtha hydrotreating unit, and the third naphtha hydrotreating unit process the plastic pyrolysis distillate naphtha stream. Similarly, the first diesel hydrotreating unit, the second diesel hydrotreating unit, and the third diesel hydrotreating unit process the plastic pyrolysis distillate diesel stream.

The associated method of producing pyrolysis products from a mixed plastics stream includes conducting pyrolysis of a plastic feedstock to produce a stream of plastic pyrolysis oil, feeding the plastic pyrolysis oil to a first fractionator to separate the plastic pyrolysis oil into a distillate fraction including naphtha and diesel boiling and a vacuum gas oil fraction comprising hydrocarbons, and feeding the distillate fraction to a three step hydrotreating operation. The three step hydrotreating operation includes feeding the distillate fraction to a first hydrotreating unit to remove di-olefins to produce a first product stream, feeding the first product stream to a second hydrotreating unit to remove mono-olefins to produce a second product stream, and feeding the second product stream to a third hydrotreating unit to remove sulfur and nitrogen by hydrodesulfurization and hydrodenitrogenation from the second product stream to produce a third product stream.

The associated method of producing pyrolysis products from a mixed plastics stream may also include separating the distillate fraction into a plastic pyrolysis distillate naphtha stream and a plastic pyrolysis distillate diesel stream in the first fractionator. With separate plastic pyrolysis distillate naphtha and plastic pyrolysis distillate diesel streams the first hydrotreating unit is split into a first naphtha hydrotreating unit and a first diesel hydrotreating unit, the second hydrotreating unit is split into a second naphtha hydrotreating unit and a second diesel hydrotreating unit, and the third hydrotreating unit is split into a third naphtha hydrotreating unit and a third diesel hydrotreating unit such that the three step hydrotreating operation is split into a plastic pyrolysis distillate naphtha hydrotreating operation and a plastic pyrolysis distillate diesel hydrotreating operation. The plastic pyrolysis distillate naphtha hydrotreating operation includes serially feeding the plastic pyrolysis distillate naphtha stream to the first naphtha hydrotreating unit to remove di-olefins, the second naphtha hydrotreating unit to remove mono-olefins, and the third naphtha hydrotreating unit to remove sulfur by hydrodesulfurization. The plastic pyrolysis distillate diesel hydrotreating operation includes serially feeding the plastic pyrolysis distillate diesel fraction to the first diesel hydrotreating unit to remove di-olefins, the second hydrotreating unit to remove mono-olefins, and the third diesel hydrotreating unit to remove sulfur and nitrogen by hydrodesulfurization and hydrodenitrogenation.

Having generally described the system and associated methods of producing pyrolysis products from a mixed plastics stream, embodiments of the same are described in further detail and with reference to the various Figures.

Referring first to FIG. 1, a schematic illustration of a one or more embodiments of the present disclosure in which a distillate fraction which include naphtha and diesel boiling in the range of 36 to 370° C. fractionated from plastic pyrolysis oil produced in the pyrolysis of a plastic feedstock is fed to a unitary three step hydrotreating operation is presented. An inlet stream 101 comprising mixed plastics is provided to a plastic pyrolysis unit 151. The plastic pyrolysis unit 151 is in fluid communication with the inlet stream 101 and is operable to generate a stream of plastic pyrolysis oil 102 from the inlet stream 101. A first fractionator 152 is in fluid communication with the plastic pyrolysis unit 151 and is operable to separate the stream of plastic pyrolysis oil 102 into a distillate fraction 103 including naphtha and diesel boiling in the range of 36 to 370° C. and a vacuum gas oil fraction 104 comprising hydrocarbons boiling above 370° C. Further, a first hydrotreating unit 154 is in fluid communication with the first fractionator 152 and is operable to remove di-olefins from the distillate fraction 103 to produce a first product stream 106 of dediolefinized plastic pyrolysis distillate, the second hydrotreating unit 155 is in fluid communication with the first hydrotreating unit 154 and is operable to remove mono-olefins from the first product stream 106 to produce a second product stream 107 of deolefinized plastic pyrolysis distillate, and the third hydrotreating unit 156 is in fluid communication with the second hydrotreating unit 155 and is operable to remove sulfur and nitrogen by hydrodesulfurization and hydrodenitrogenation from the second product stream 107 to produce a third product stream 108 of hydrodesulfurized and hydrodenitrogenized plastic pyrolysis distillate.

Plastic Feedstock

In one or more embodiments the inlet stream 101 comprises a plastic feedstock including mixed plastics of differing compositions. The plastic feedstock provided to the plastic pyrolysis unit 151 may be a mixture of plastics from various polymer families. In various embodiments, the plastic feedstock may comprise plastics representative of one or more of the polymer families disclosed in Table 1. Specifically, the plastic feedstock may comprise plastics representative of one or more of olefins, carbonates, aromatic polymers, sulfones, fluorinated hydrocarbon polymers, chlorinated hydrocarbon polymers, and acrylonitriles. Further, the plastic feedstock provided to the plastic pyrolysis unit 151 may be a mixture of high density polyethylene (HDPE, for example, a density of about 0.93 to 0.97 grams per cubic centimeter ($g/cm^3$), low density polyethylene (LDPE, for example, about 0.910 $g/cm^3$ to 0.940 $g/cm^3$), polypropylene (PP), linear low density polyethylene (LLDPE), polystyrene (PS), polyethylene terephthalate (PET). It will be appreciated that utilization of the mixed plastics feedstock allows for recycling of plastics without necessitating fine sorting of the plastics.

TABLE 1

| Example Polymers | | | |
|---|---|---|---|
| Polymer family | Example polymer | Melting Point, ° C. | Structure |
| Olefins | Polyethylene (PE) | 115-135 | 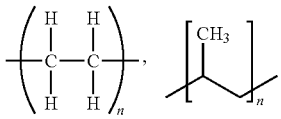 |
| Olefins | Polypropylene (PP) | 115-135 | 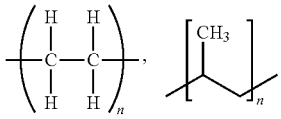 |
| carbonates | diphenylcarbonate | 83 | 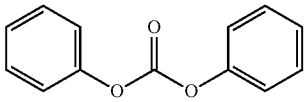 |
| aromatics | Polystyrene (PS) | 240 | 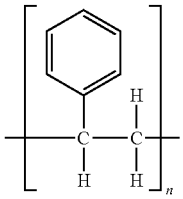 |
| Sulfones | Polyether sulfone | 227-238 | 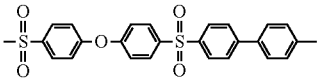 |
| Fluorinated hydrocarbons | Polytetrafluoroethylene (PTFE) | 327 | 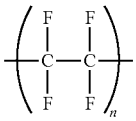 |
| Chlorinated hydrocarbons | Polyvinyl chloride (PVC) | 100-260 | 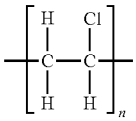 |
| Acyrilnitriles | Polyacrylonitrile (PAN) | 300 | 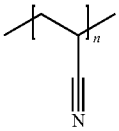 |

The plastics of the inlet stream 101 may be provided in a variety of different forms. The plastics may be in the form of a powder in smaller scale operations. The plastics may be in the form of pellets, such as those with a particle size of from 1 to 5 millimeter (mm) for larger scale operations. In further embodiments, the plastics may be provided as a chopped or ground product. Further, the plastics of the inlet stream 101 may be natural, synthetic or semi-synthetic polymers. In various embodiments, the plastics of the inlet stream 101 may comprise waste plastic, manufacturing off-spec product, new plastic products, unused plastic products, as well as their combinations.

Plastic Pyrolysis

The plastic pyrolysis unit 151 converts the inlet stream 101 of plastics to gaseous and liquid products. The liquid products are provided as an effluent from the plastic pyrolysis unit 151 as the stream of plastic pyrolysis oil 102. The stream of gaseous products are generically shown in FIGS. 1 and 2 as off-gas stream 110. The gaseous products in the off-gas stream 110 may include various species such as hydrogen and hydrocarbon gases (C1-C4), carbon monoxide (CO), carbon dioxide ($CO_2$), and other acid gases.

The specific reactor used as the plastic pyrolysis unit 151 can be of different types and are not limited for the purposes of the present disclosure. One skilled in the art will appreciate that typical reactor types that can be used to serve the function of the plastic pyrolysis unit 151 are tank reactors, rotary kilns, packed beds, bubbling and circulating fluidized bed and others. In one or more embodiments, the pyrolysis of the plastic feedstock in the inlet stream 101 is performed in the presence or absence of a catalyst at a temperature of 300 to 1000° C. In various further embodiments, the plastic pyrolysis unit 151 may operate at a low severity at a temperature less than or equal to 450° C., at a high severity at a temperature at a temperature greater than 450° C., at a temperature of 300 to 450° C., at a temperature of 450 to 1000° C., at a temperature of 450 to 750° C., at a temperature of 600 to 1000° C., or at a temperature of 750 to 1000° C. In various embodiments, the plastic pyrolysis unit 151 may operate at a pressure in the range of 1 to 100 bars, 1 to 50 bars, 1 to 25 bars, or 1 to 10 bars. Further, in various embodiments, the residence time of the plastic feedstock in the plastic pyrolysis unit 151 may be 1 to 3600 seconds, 60 to 1800 seconds, or 60 to 900 seconds.

In one or more embodiments, stream of plastic pyrolysis oil 102 exiting the plastic pyrolysis unit 151 may be mixed with refinery fractions. Specifically, the composition of plastic oil in the stream of plastic pyrolysis oil 102 as fed to the first fractionator 152 may vary from 1 weight percent (wt. %) to 100 wt. % with the remainder comprising conventional refinery streams. In various embodiments, the composition of plastic oil in the stream of plastic pyrolysis oil 102 as fed to the first fractionator 152 may comprise 1 to 100 wt. % plastic oil, 20 to 100 wt. % plastic oil, 40 to 100 wt. % plastic oil, 60 to 100 wt. % plastic oil, 80 to 100 wt. % plastic oil, or substantially 100 wt. % plastic oil.

First Fractionator

The first fractionator 152 may comprise any unit operation or system known to those skilled in the art for separating a hydrocarbon stream by vapor pressure. An example fractionation unit is an atmospheric distillation unit. An atmospheric distillation unit utilizes fractional distillation by heating the feed to a temperature at which one or more fractions of the mixture will vaporize while leaving other fractions as liquid to separate the feed stream. Further, in various embodiments, the first fractionator 152 may be a simple flash column or true boiling point distillation with at least 15 theoretical plates. In one or more embodiments, the first fractionator 152 separates the stream of plastic pyrolysis oil 102 into a distillate fraction 103 including naphtha and diesel boiling in the range of 36 to 370° C. and a vacuum gas oil fraction 104 comprising hydrocarbons boiling above 370° C.

It is noted that when the plastic feedstock includes polymers that contain sulfur, chlorine, or fluorine, treatment of the plastic pyrolysis oil 102 may be desirable before hydrotreating to remove such heteroatoms. The pretreatment may be completed before or after the first fractionator 152.

Hydrotreating Units

The first hydrotreating unit 154 is in fluid communication with the first fractionator 152 and is operable to remove di-olefins by hydrogenation from the distillate fraction 103 to produce the first product stream 106. The first product stream 106 is dediolefinized plastic pyrolysis distillate. It will be appreciated that in one or more embodiments di-olefins are removed completely from the distillate fraction 103. For purposes of the present disclosure the term "removed completely" means di-olefins were reduced to less than 1 weight percent, less than 0.1 weight percent, less than 0.01 weight percent, or less than 0.001 weight percent.

In one or more embodiments, the first hydrotreating unit 154 may be a fixed bed reactor in combination with any known hydrogenation catalyst. However, the first hydrotreating unit 154 is not intended to be limited to any specific type of reactor.

In one or more embodiments, the first hydrotreating unit 154 includes a first hydrogenation catalyst. The first hydrogenation catalyst may comprise a nickel catalyst on one or more of an alumina support, a silica support, and a titania support. For example, the first hydrogenation catalyst may comprise nickel catalyst on an alumina support or nickel-molybdenum (Ni—Mo) catalyst in an alumina support.

In one or more embodiments the first hydrotreating unit 154 is operated at a temperature of 150 to 210° C. In various further embodiments, the first hydrotreating unit 154 is operated at a temperature of 150 to 200° C., 150 to 190° C., 150 to 180° C., or approximately 175° C.

In one or more embodiments the first hydrotreating unit 154 is operated at a hydrogen pressure at the inlet of 10 to 25 bar. In various further embodiments, the first hydrotreating unit 154 is operated at a hydrogen pressure at the inlet of 10 to 25 bar, 15 to 22 bar, 15 to 20 bar, or approximately 17 bar.

In one or more embodiments the first hydrotreating unit 154 is operated at a liquid hourly space velocity (LHSV) of 1 to 5 inverse hours ($h^{-1}$). In various further embodiments, the first hydrotreating unit 154 is operated at an LHSV of 1 to 4 $h^{-1}$, 1 to 3 $h^{-1}$, or approximately 2 $h^{-1}$.

In one or more embodiments the first hydrotreating unit 154 is operated at a hydrogen recycle rate of 50 to 300 standard cubic meters per cubic meter ($Sm^3/m^3$). One skilled in the art will appreciate that standard cubic meters are measured at a temperature of 15° C. and pressure of 1.01325 bar. In various further embodiments, the first hydrotreating unit 154 is operated at a hydrogen recycle rate of 60 to 250 $Sm^3/m^3$, 65 to 180 $Sm^3/m^3$, 70 to 110 $Sm^3/m^3$, or approximately 75 $Sm^3/m^3$.

The second hydrotreating unit 155 is in fluid communication with the first hydrotreating unit 154 and is operable to remove mono-olefins by hydrogenation from the first product stream 106 to produce the second product stream 107. The second product stream 107 is deolefinized plastic pyrolysis distillate. It will be appreciated that in one or more embodiments, mono-olefins are removed completely from the first product stream 106. For purposes of the present disclosure the term "removed completely" means mono-olefins were reduced to less than 1 weight percent, less than 0.1 weight percent, less than 0.01 weight percent, or less than 0.001 weight percent.

In one or more embodiments, the second hydrotreating unit 155 may be a fixed bed reactor in combination with any known hydrogenation catalyst. However, the second hydrotreating unit 155 is not intended to be limited to any specific type of reactor.

In one or more embodiments, the second hydrotreating unit 155 includes a second hydrogenation catalyst. The second hydrogenation catalyst may comprise a nickel catalyst on one or more of an alumina support, a silica support, and a titania support. For example, the second hydrogenation catalyst may comprise nickel catalyst on an alumina support or nickel-molybdenum (Ni—Mo) catalyst in an alumina support.

In one or more embodiments the second hydrotreating unit 155 is operated at a temperature of 250 to 330° C. In various further embodiments, the second hydrotreating unit 155 is operated at a temperature of 300 to 325° C., 300 to 320° C., 300 to 310° C., or approximately 300° C.

In one or more embodiments the second hydrotreating unit 155 is operated at a hydrogen pressure at the inlet of 10 to 25 bar. In various further embodiments, the second hydrotreating unit 155 is operated at a hydrogen pressure at the inlet of 15 to 25 bar, 15 to 22 bar, 15 to 20 bar, or approximately 17 bar.

In one or more embodiments the second hydrotreating unit 155 is operated at a LHSV of 1 to 5 $h^{-1}$. In various further embodiments, the first hydrotreating unit 154 is operated at an LHSV of 1 to 4 $h^{-1}$, 1 to 3 $h^{-1}$, 1 to 2 $h^{-1}$, or approximately 1.5 $h^{-1}$.

In one or more embodiments the second hydrotreating unit 155 is operated at a hydrogen recycle rate of 200 to 500 $Sm^3/m^3$. In various further embodiments, the second hydrotreating unit 155 is operated at a hydrogen recycle rate of 250 to 475 $Sm^3/m^3$, 300 to 450 $Sm^3/m^3$, 350 to 425 $Sm^3/m^3$, or approximately 425 $Sm^3/m^3$.

It is noted that the diolefin removal in the first hydrotreating unit 154 is completed at a lower temperature than the olefin removal in the second hydrotreating unit 155. As a result, it is to include two separate hydrotreating steps. This is in contravention to any existing systems which do not utilize the multi-stage hydrotreating operations of the present disclosure, such previous systems being incapable of achieving the complete olefin and di-olefin removal demonstrated in the presently disclosed system.

The third hydrotreating unit 156 is in fluid communication with the second hydrotreating unit 155 and is operable to remove sulfur and nitrogen by hydrodesulfurization and hydrodenitrogenation from the second product stream 107 to produce the third product stream 108. The third product stream 108 is clean plastic pyrolysis distillate. For purposes of this disclosure the term clean is utilized to mean the stream has less than 10 parts per million (ppm) of sulfur and less than 10 ppm of nitrogen. It will be appreciated that in one or more embodiments sulfur may removed from the second product stream 107 to generate the third product stream 108 having less than 10 ppm or less than 0.5 parts per million by weight (ppmw) of sulfur. In various further embodiments, sulfur in the third product stream 108 is reduced to below 0.2 ppmw, 0.1 ppmw, 0.05 ppmw, or 0.01 ppmw. Similarly, in one or more embodiments nitrogen may be removed from the second product stream 107 to generate the third product stream 108 having less than 10 ppm or less than 0.5 ppmw of nitrogen. In various further embodiments, nitrogen in the third product stream 108 is reduced to below 0.2 ppmw, 0.1 ppmw, 0.05 ppmw, or 0.01 ppmw. Further, residual mono-olefins or di-olefins may be removed from the second product stream 107 in the top section of the third hydrotreating unit 156.

In one or more embodiments, the third hydrotreating unit 156 may be a fixed bed reactor in combination with any known hydrotreating catalyst. However, the third hydrotreating unit 156 is not intended to be limited to any specific type of reactor.

In one or more embodiments, the third hydrotreating unit 156 includes a third hydrotreating catalyst. The third hydrotreating catalyst may comprise a catalyst comprising one or more of Cobalt, Nickel, and Molybdenum singly or in combination on one or more of an alumina support, a silica support, and a titania support. For example, the third hydrotreating catalyst may comprise cobalt-molybdenum catalyst on an alumina support.

In one or more embodiments the third hydrotreating unit 156 is operated at a temperature of 330 to 420° C. In various further embodiments, the third hydrotreating unit 156 is operated at a temperature of 330 to 400° C., 330 to 380° C., 330 to 350° C., or approximately 330° C.

In one or more embodiments the third hydrotreating unit 156 is operated at a hydrogen pressure at the inlet of 15 to 60 bar. In various further embodiments, the third hydrotreating unit 156 is operated at a hydrogen pressure at the inlet of 20 to 50 bar, 30 to 40 bar, or approximately 30 bar.

In one or more embodiments the third hydrotreating unit 156 is operated at a LHSV of 0.5 to 10 $h^{-1}$. In various further embodiments, the first hydrotreating unit 154 is operated at an LHSV of 1 to 9 $h^{-1}$, 3 to 8 $h^{-1}$, 5 to 7 $h^{-1}$, or approximately 6 $h^{-1}$.

In one or more embodiments the third hydrotreating unit 156 is operated at a hydrogen recycle rate of 200 to 600 $Sm^3/m^3$. In various further embodiments, the second hydrotreating unit 155 is operated at a hydrogen recycle rate of 200 to 500 $Sm^3/m^3$, 200 to 400 $Sm^3/m^3$, 200 to 250 $Sm^3/m^3$, or approximately 200 $Sm^3/m^3$.

In one or more embodiments, the third product stream 108 is provided to a second fractionator 157 to generate a hydrotreated plastic pyrolysis naphtha stream 109 and a hydrotreated plastic pyrolysis diesel stream 110 based on fractionation at a hydrocarbon boiling point of 160 to 220° C. In various further embodiments, the hydrotreated plastic pyrolysis naphtha stream 109 and the hydrotreated plastic pyrolysis diesel stream 110 are generated based on fractionation at a hydrocarbon boiling point of 170 to 200° C., 160 to 190° C., 170 to 190° C., or approximately 180° C. The second fractionator 157 may comprise any unit operation or system known to those skilled in the art for separating a hydrocarbon stream by vapor pressure.

Figure 2:
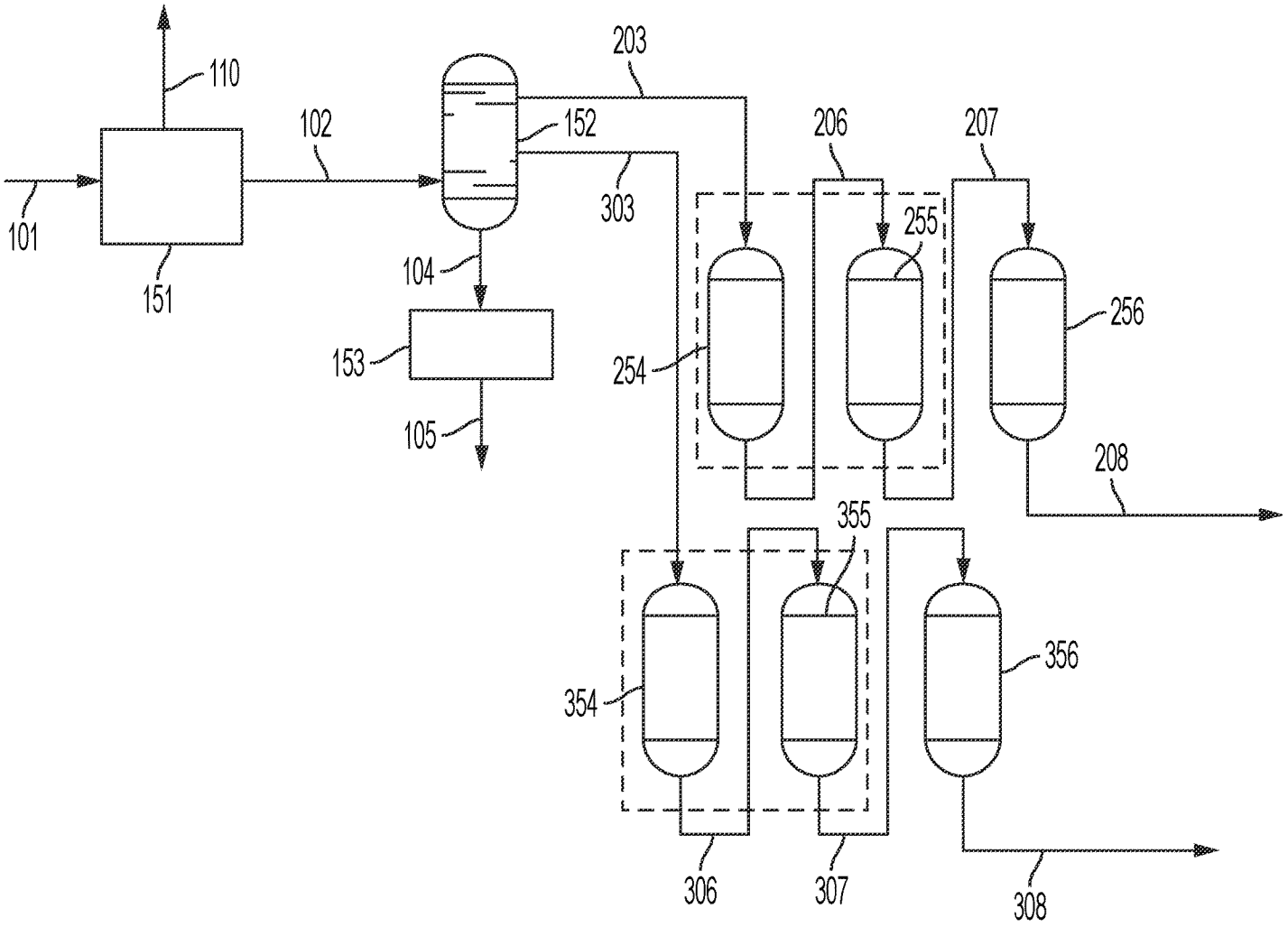
FIG. 2 is a schematic illustration of one or more embodiments of the present disclosure, in which a distillate fraction fractionated from plastic pyrolysis oil produced in the pyrolysis of a plastic feedstock is separated into a plastic pyrolysis distillate naphtha stream and a plastic pyrolysis distillate diesel stream with each separately fed to a distinct three step hydrotreating operation.

Referring now to FIG. 2, a schematic illustration of one or more embodiments of the present disclosure in which a plastic pyrolysis distillate naphtha stream and a plastic pyrolysis distillate diesel stream are fractionated from plastic pyrolysis oil produced in the pyrolysis of a plastic feedstock are each separately fed to a distinct three step hydrotreating operation is presented.

In one or more embodiments, the inlet stream 101 comprising mixed plastics is provided to the plastic pyrolysis unit 151. The plastic pyrolysis unit 151 is in fluid communication with the inlet stream 101 and is operable to generate the stream of plastic pyrolysis oil 102 from the inlet stream 101. The first fractionator 152 is in fluid communication with the plastic pyrolysis unit 151 and is operable to separate the stream of plastic pyrolysis oil 102 into a plastic pyrolysis distillate naphtha stream 203 comprising hydrocarbons boiling in the range of 36 to 180° C., a plastic pyrolysis distillate diesel stream 303 comprising hydrocarbons boiling in the range of 180 to 370° C., and the vacuum gas oil fraction 104 comprising hydrocarbons boiling above 370° C. In such arrangement the plastic pyrolysis distillate naphtha stream 203 is provided to a dedicated three step hydrotreating unit and the plastic pyrolysis distillate diesel stream 303 is provided to a separate dedicated three step hydrotreating unit. In various further embodiments, the split between the plastic pyrolysis distillate naphtha stream 203 and the plastic pyrolysis distillate diesel stream 303 is generated based on fractionation at a hydrocarbon boiling point of 160 to 220° C., 160 to 190° C., 170 to 190° C., or 175 to 185° C.

The plastic pyrolysis distillate naphtha stream 203 is processed with a first naphtha hydrotreating unit 254, a second naphtha hydrotreating unit 255, and a third naphtha hydrotreating unit 256. The first naphtha hydrotreating unit 254 is in fluid communication with the first fractionator 152 and operable to remove di-olefins by hydrogenation from the plastic pyrolysis distillate naphtha stream 203 provided from the first fractionator 152 to produce a first naphtha product stream 206 of dediolefinized plastic pyrolysis distillate naphtha. The second naphtha hydrotreating unit 255 is in fluid communication with the first naphtha hydrotreating unit 254 and operable to remove mono-olefins by hydrogenation from the first naphtha product stream 206 provided from the first naphtha hydrotreating unit 254 to produce a second naphtha product stream 207 of deolefinized plastic pyrolysis distillate naphtha. The third naphtha hydrotreating unit 256 is in fluid communication with the second naphtha hydrotreating unit 255 and operable to remove sulfur and nitrogen by hydrodesulfurization and hydrodenitrogenation from the second naphtha product stream 207 provided from the second naphtha hydrotreating unit 255 to produce a third naphtha product stream 208 of clean plastic pyrolysis distillate naphtha.

In one or more embodiments the first naphtha hydrotreating unit 254 may have the same configuration and operating parameters as the first hydrotreating unit 154. Specifically, the first naphtha hydrotreating unit 254 may be a fixed bed reactor in combination with any known hydrogenation catalyst, although the first naphtha hydrotreating unit 254 is not intended to be limited to any specific type of reactor. Further, the operating parameters including operating temperature, hydrogen pressure at inlet, LHSV, and the hydrogen recycle rate as disclosed with regards to the first hydrotreating unit 154 are transferable to the first naphtha hydrotreating unit 254.

In one or more embodiments di-olefins are removed completely from the plastic pyrolysis distillate naphtha stream 203 in the first naphtha hydrotreating unit 254. For purposes of the present disclosure the term "removed completely" means di-olefins were reduced to less than 1 weight percent, less than 0.1 weight percent, less than 0.01 weight percent, or less than 0.001 weight percent.

In one or more embodiments, the first naphtha hydrotreating unit 254 may include the first hydrogenation catalyst. As indicated with respect to the first hydrotreating unit 154, the first hydrogenation catalyst may comprise a nickel catalyst on one or more of an alumina support, a silica support, and a titania support such as a nickel catalyst on an alumina support or nickel-molybdenum (Ni—Mo) catalyst in an alumina support.

In one or more embodiments the second naphtha hydrotreating unit 255 may have the same configuration and operating parameters as the second hydrotreating unit 155. Specifically, the second naphtha hydrotreating unit 255 may be a fixed bed reactor in combination with any known hydrogenation catalyst, although the second naphtha hydrotreating unit 255 is not intended to be limited to any specific type of reactor. Further, the operating parameters including operating temperature, hydrogen pressure at inlet, LHSV, and the hydrogen recycle rate as disclosed with regards to the second hydrotreating unit 155 are transferable to the second naphtha hydrotreating unit 255.

In one or more embodiments mono-olefins are removed completely from the first naphtha product stream 206 in the second naphtha hydrotreating unit 255. For purposes of the present disclosure the term "removed completely" means mono-olefins were reduced to less than 1 weight percent, less than 0.1 weight percent, less than 0.01 weight percent, or less than 0.001 weight percent.

In one or more embodiments, the second naphtha hydrotreating unit 255 may include the second hydrogenation catalyst. As indicated with respect to the second hydrotreating unit 155, the second hydrogenation catalyst may comprise a nickel catalyst on one or more of an alumina support, a silica support, and a titania support such as a nickel catalyst on an alumina support or nickel-molybdenum (Ni—Mo) catalyst in an alumina support.

In one or more embodiments the third naphtha hydrotreating unit 256 may have the same configuration and operating parameters as the third hydrotreating unit 156. Specifically, the third naphtha hydrotreating unit 256 may be a fixed bed reactor in combination with any known hydrogenation catalyst, although the third naphtha hydrotreating unit 256 is not intended to be limited to any specific type of reactor. Further, many of the operating parameters including operating temperature, LHSV, and the hydrogen recycle rate as disclosed with regards to the third hydrotreating unit 156 are transferable to the third naphtha hydrotreating unit 256.

It is noted that the hydrogen pressure at the inlet may be different for the third naphtha hydrotreating unit 256 compared to the third hydrotreating unit 156. In one or more embodiments the third naphtha hydrotreating unit 256 is operated at a hydrogen pressure at the inlet of 5 to 15 bar. In various further embodiments, the third naphtha hydrotreating unit 256 is operated at a hydrogen pressure at the inlet of 5 to 12 bar, 8 to 15 bar, 8 to 12 bar, or approximately 10 bar. Further, it is noted that additional hydrogen may be supplied to each of the hydrotreating units and particularly the third naphtha hydrotreating unit 256 to keep the pressure at the desired level In one or more embodiments, the third naphtha hydrotreating unit 256 may include the third hydrotreating catalyst. As indicated with respect to the third hydrotreating unit 156, the third hydrotreating catalyst may comprise a catalyst comprising one or more of Cobalt, Nickel, and Molybdenum singly or in combination on one or more of an alumina support, a silica support, and a titania support such as a cobalt-molybdenum catalyst on an alumina support.

It will be appreciated that in one or more embodiments sulfur and nitrogen is removed from the second naphtha product stream 207 in the third naphtha hydrotreating unit 256 to generate the third naphtha product stream 208 having less than 10 ppm or 0.5 ppmw of sulfur and nitrogen individually. In various further embodiments, sulfur in the third naphtha product stream 208 is reduced to below 0.2 ppmw, 0.1 ppmw, 0.05 ppmw, or 0.01 ppmw. Similarly, in various embodiments, nitrogen in the third naphtha product stream 208 is reduced to below 0.2 ppmw, 0.1 ppmw, 0.05 ppmw, or 0.01 ppmw. Further, residual mono-olefins or di-olefins may be removed from the second naphtha product stream 207 in the top section of the third naphtha hydrotreating unit 256.

The plastic pyrolysis distillate diesel stream 303 is processed with a first diesel hydrotreating unit 354, a second diesel hydrotreating unit 355, and a third diesel hydrotreating unit 356. The first diesel hydrotreating unit 354 is in fluid communication with the first fractionator 152 and operable to remove di-olefins by hydrogenation from the plastic pyrolysis distillate diesel stream 303 provided from the first fractionator 152 to produce a first diesel product stream 306 of dediolefinized plastic pyrolysis distillate diesel. The second diesel hydrotreating unit 355 is in fluid communication with the first diesel hydrotreating unit 354 and operable to remove mono-olefins by hydrogenation from the first diesel product stream 306 provided from the first diesel hydrotreating unit 354 to produce a second diesel product stream 307 of deolefinized plastic pyrolysis distillate diesel. The third diesel hydrotreating unit 356 is in fluid communication with the second diesel hydrotreating unit 355 and operable to remove sulfur and nitrogen by hydrodesulfurization and hydrodenitrogenation from the second diesel product stream 307 provided from the second diesel hydrotreating unit 355 to produce a third diesel product stream 308 of clean plastic pyrolysis distillate diesel.

In one or more embodiments the first diesel hydrotreating unit 354 may have the same configuration and operating parameters as the first hydrotreating unit 154. Specifically, the first diesel hydrotreating unit 354 may be a fixed bed reactor in combination with any known hydrogenation catalyst, although the first diesel hydrotreating unit 354 is not intended to be limited to any specific type of reactor. Further, the operating parameters including operating temperature, hydrogen pressure at inlet, LHSV, and the hydrogen recycle rate as disclosed with regards to the first hydrotreating unit 154 are transferable to the first diesel hydrotreating unit 354.

In one or more embodiments di-olefins are removed completely from the plastic pyrolysis distillate diesel stream 303 in the first diesel hydrotreating unit 354. For purposes of the present disclosure the term "removed completely" means di-olefins were reduced to less than 1 weight percent, less than 0.1 weight percent, less than 0.01 weight percent, or less than 0.001 weight percent.

In one or more embodiments, the first diesel hydrotreating unit 354 may include the first hydrogenation catalyst. As indicated with respect to the first hydrotreating unit 154, the first hydrogenation catalyst may comprise a nickel catalyst on one or more of an alumina support, a silica support, and a titania support such as a nickel catalyst on an alumina support.

In one or more embodiments the second diesel hydrotreating unit 355 may have the same configuration and operating parameters as the second hydrotreating unit 155. Specifically, the second diesel hydrotreating unit 355 may be a fixed bed reactor in combination with any known hydrogenation catalyst, although the second diesel hydrotreating unit 355 is not intended to be limited to any specific type of reactor. Further, the operating parameters including operating temperature, hydrogen pressure at inlet, LHSV, and the hydrogen recycle rate as disclosed with regards to the second hydrotreating unit 155 are transferable to the second diesel hydrotreating unit 355.

In one or more embodiments mono-olefins are removed completely from the first diesel product stream 306 in the second diesel hydrotreating unit 355. For purposes of the present disclosure the term "removed completely" means mono-olefins were reduced to less than 1 weight percent, less than 0.1 weight percent, less than 0.01 weight percent, or less than 0.001 weight percent.

In one or more embodiments, the second diesel hydrotreating unit 355 may include the second hydrogenation catalyst. As indicated with respect to the second hydrotreating unit 155, the second hydrogenation catalyst may comprise a nickel catalyst on one or more of an alumina support, a silica support, and a titania support such as a nickel catalyst on an alumina support.

In one or more embodiments the third diesel hydrotreating unit 356 may have the same configuration and operating parameters as the third hydrotreating unit 156. Specifically, the third diesel hydrotreating unit 356 may be a fixed bed reactor in combination with any known hydrogenation catalyst, although the third diesel hydrotreating unit 356 is not intended to be limited to any specific type of reactor. Further, many of the operating parameters including operating temperature, LHSV, and the hydrogen recycle rate as disclosed with regards to the third hydrotreating unit 156 are transferable to the third diesel hydrotreating unit 356.

It is noted that the hydrogen pressure at the inlet may be different for the third diesel hydrotreating unit 356 compared to the third hydrotreating unit 156 and the third naphtha hydrotreating unit 256. In one or more embodiments the third diesel hydrotreating unit 356 is operated at a hydrogen pressure at the inlet of 15 to 25 bar. In various further embodiments, the third naphtha hydrotreating unit 256 is operated at a hydrogen pressure at the inlet of 15 to 22 bar, 17 to 25 bar, 17 to 22 bar, or approximately 20 bar.

In one or more embodiments, the third naphtha hydrotreating unit 256 may include the third hydrotreating catalyst. As indicated with respect to the third hydrotreating unit 156, the third hydrotreating catalyst may comprise a catalyst comprising one or more of Cobalt, Nickel, and Molybdenum singly or in combination on one or more of an alumina support, a silica support, and a titania support such as a cobalt-molybdenum catalyst on an alumina support.

It will be appreciated that in one or more embodiments sulfur is removed from the second diesel product stream 307 in the third diesel hydrotreating unit 356 to generate the third diesel product stream 308 having less than 10 ppm or 0.5 ppmw of sulfur and nitrogen individually. In various further embodiments, sulfur in the third diesel product stream 308 is reduced to below 0.2 ppmw, 0.1 ppmw, 0.05 ppmw, or 0.01 ppmw. Similarly, in various embodiments, nitrogen in the third diesel product stream 308 is reduced to below 0.2 ppmw, 0.1 ppmw, 0.05 ppmw, or 0.01 ppmw. Further, residual mono-olefins or di-olefins may be removed from the second diesel product stream 307 in the top section of the third diesel hydrotreating unit 356.

In one or more embodiments, the vacuum gas oil fraction 104 comprising hydrocarbons boiling above 370° C. is provided to a demetallization operation 153 to remove metallic constituents from the vacuum gas oil fraction 104 and generate a demetallized vacuum gas oil stream 105.

In one or more embodiments, the demetallization operation 153 may be catalytic hydrodemetallization. U.S. Pat. No. 8,491,779, incorporated by reference, teaches the integration of catalytic hydrodemetallization (HDM) into a refinery process. The HDM step is carried out in the presence of a catalyst and hydrogen. Further, in one or more embodiments, the hydrogen that is used can come from a downstream step. The HDM is generally carried out at 370 to 415° C. and pressure of 30 to 200 bars. Also, see U.S. Pat. No. 5,417,846, incorporated by reference, teaching HDM, as well as U.S. Pat. Nos. 4,976,848; 4,657,664; 4,166,026; and 3,891,541, all of which are incorporated by reference.

In one or more embodiments, the demetallization operation 153 may be solvent deasphalting. The process of solvent deasphalting results in the metal containing hydrocarbons of the processed streaming end up in an asphaltenes stream of a solvent deasphalting unit. U.S. Pat. No. 7,566,394, incorporated by reference, teaches details of a solvent deasphalting process Having described the system for processing mixed plastics into plastic pyrolysis products, it is expressly indicated that the associated method of producing pyrolysis products from a mixed plastics stream using the same is also envisioned. The method includes conducting pyrolysis of a plastic feedstock to produce a stream of plastic pyrolysis oil 102, feeding the plastic pyrolysis oil 102 to a first fractionator 152 to separate the plastic pyrolysis oil 102 into a distillate fraction 103 including naphtha and diesel boiling in the range of 36 to 370° C. and a vacuum gas oil fraction 104 comprising hydrocarbons boiling above 370° C., and feeding the distillate fraction 103 to a three step hydrotreating operation. The three step hydrotreating operation includes feeding the distillate fraction 103 to the first hydrotreating unit 154 configured and operated to remove di-olefins by hydrogenation from the distillate fraction 103 to produce the first product stream 106 of dediolefinized plastic pyrolysis distillate, feeding the first product stream 106 to the second hydrotreating unit 155 configured and operated to remove mono-olefins by hydrogenation from the first product stream 106 to produce the second product stream 107 of deolefinized plastic pyrolysis distillate, and feeding the second product stream 107 to the third hydrotreating unit 156 configured and operated to remove sulfur and nitrogen by hydrodesulfurization and hydrodenitrogenation from the second product stream 107 to produce the third product stream 108 of clean plastic pyrolysis distillate.

The method of producing pyrolysis products from a mixed plastics stream may also include further separating the distillate fraction into the plastic pyrolysis distillate naphtha stream 203 and the plastic pyrolysis distillate diesel stream 303 in the first fractionator 152. With the separate plastic pyrolysis distillate naphtha stream 203 and plastic pyrolysis distillate diesel stream 303 the first hydrotreating unit is split into the first naphtha hydrotreating unit 254 and the first diesel hydrotreating unit 354, the second hydrotreating unit is split into the second naphtha hydrotreating unit 255 and the second diesel hydrotreating unit 355, and the third hydrotreating unit is split into the third naphtha hydrotreating unit 256 and the third diesel hydrotreating unit 356 such that the three step hydrotreating operation is split into a plastic pyrolysis distillate naphtha hydrotreating operation and a plastic pyrolysis distillate diesel hydrotreating operation.

The plastic pyrolysis distillate naphtha hydrotreating operation includes feeding the plastic pyrolysis distillate naphtha stream 203 to the first naphtha hydrotreating unit 254 to remove di-olefins from the plastic pyrolysis distillate naphtha stream 203 to produce the first naphtha product stream 206 of dediolefinized plastic pyrolysis distillate naphtha, feeding the first naphtha product stream 206 to the second naphtha hydrotreating unit 255 to remove mono-olefins from the first naphtha product stream 206 to produce the second naphtha product stream 207 of deolefinized plastic pyrolysis distillate naphtha, and feeding the second naphtha product stream 255 to the third naphtha hydrotreating unit 256 to remove sulfur and nitrogen by hydrodesulfurization and hydrodenitrogenation from the second naphtha product stream 207 to produce the third naphtha product stream 208 of clean plastic pyrolysis distillate naphtha.

The plastic pyrolysis distillate diesel hydrotreating operation includes feeding the plastic pyrolysis distillate diesel fraction 303 to the first diesel hydrotreating unit 354 to remove di-olefins from the plastic pyrolysis distillate diesel stream 303 to produce the first diesel product stream 306 of dediolefinized plastic pyrolysis distillate diesel, feeding the first diesel product stream 306 to the second hydrotreating unit 355 to remove mono-olefins from the first diesel product stream 306 to produce the second diesel product stream 307 of deolefinized plastic pyrolysis distillate diesel, and feeding the second diesel product stream 307 to the third diesel hydrotreating unit 356 to remove sulfur and nitrogen by hydrodesulfurization and hydrodenitrogenation from the second diesel product stream 307 to produce the third diesel product stream 308 of clean plastic pyrolysis distillate diesel.

In one or more embodiments, the system for processing mixed plastics into plastic pyrolysis products may be integrated with a conventional refinery. For purposes of this disclosure a conventional refinery is meant as to reference an existing refining operation for processing crude oil into a plurality of useful products. An example of a conventional refinery is illustrated in FIG. 3 along with notation with regards to where the various product streams of the presently disclosed system for processing mixed plastics into plastic pyrolysis products may be integrated as useful feedstreams.

As the various unit operations present within the exemplary conventional refinery are known to one skilled in the art, nuanced detail of each is not provided. Instead each unit operation and the streams passed between the various unit operations are simply noted in accordance with the following tables.

TABLE 2

Figure 3:
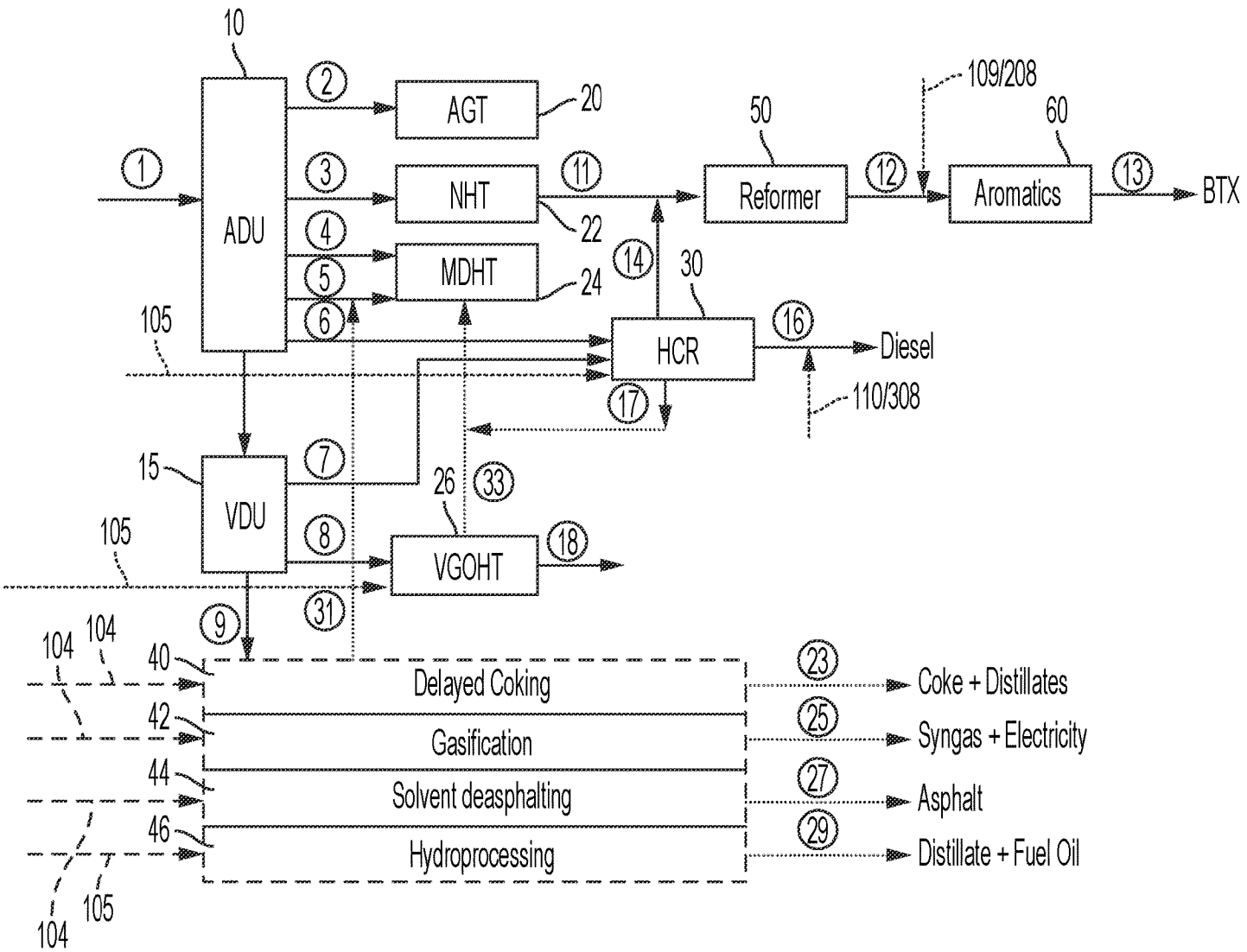
FIG. 3 is a schematic illustration of an embodiment of the present disclosure, in which the product streams from the hydrotreated pyrolysis oils generated in FIG. 1 or 2 are provided as feedstock to individual unit operations within a conventional refinery.

| Conventional Refinery Vessels—FIG. 3 | |
|---|---|
| 10 | Atmospheric distillation unit (ADU) |
| 15 | Vacuum distillation unit (VDU) |
| 20 | Acid gas treatment unit (AGT) |
| 22 | Naphtha hydrotreating unit (NHT) |
| 24 | Mid-distillate hydrotreating unit (MDHT) |
| 26 | VGO Hydrotreating unit (VGOHT) |
| 30 | Hydrocracking unit (HCR) |
| 40 | Delayed coking unit |
| 42 | Gasification Unit |
| 44 | Solvent deasphalting unit |
| 46 | Hydroprocessing unit |
| 50 | Reformer |
| 60 | Aromatic recovery unit |

TABLE 3

| Conventional Refinery Process Streams—FIG. 3 | |
|---|---|
| 1 | Crude Oil |
| 2 | Acid gas |
| 3 | Naphtha |
| 4 | Jet/Kerosene |
| 5 | Diesel |
| 6 | Heavy gas oil |
| 7 | Light vacuum gas oil |
| 8 | Heavy vacuum gas oil |
| 9 | Vacuum residue |
| 11 | Hydrotreated naphtha |
| 12 | Reformate |
| 13 | Benzene, Toluenen, Xylenes (BTX) |
| 14 | Hydrocracked naphtha |
| 16 | Diesel |
| 17 | Hydrocracked diesel |
| 18 | Hydrotreated VGO |
| 23 | Coke + Distillates |
| 25 | Syngas elctricity |
| 27 | Asphalt + Deasphalted oil |
| 29 | Distillates + Fuel Oil |
| 31 | Distillate from delayed coking and hydroprocessing |

In one or more embodiments, the hydrotreated plastic pyrolysis naphtha stream 109 is directly provided to an aromatic recovery unit 60 within the conventional refinery. Similarly, in one or more embodiments, the hydrotreated plastic pyrolysis diesel stream 110 is combined with a diesel output stream 16 from the conventional refinery. It will be appreciated that in one or more embodiments, both the hydrotreated plastic pyrolysis naphtha stream 109 may be directly provided to an aromatic recovery unit 60 and the hydrotreated plastic pyrolysis diesel stream 110 may be combined with the diesel output stream 110 from the conventional refinery.

Similarly, in one or more embodiments with the parallel three step hydrotreating units which process the naphtha and diesel fractions separately, the third naphtha product stream 208 of clean plastic pyrolysis distillate naphtha is directly provided to an aromatic recovery unit 60 within the conventional refinery. Similarly, in one or more embodiments, the third diesel product stream 308 of clean plastic pyrolysis distillate diesel is combined with a diesel output stream 16 from the conventional refinery. It will be appreciated that in one or more embodiments, both the third naphtha product stream 208 may be directly provided to an aromatic recovery unit 60 and the third diesel product stream 308 may be combined with the diesel output stream 110 from the conventional refinery.

In one or more embodiments, integration with the conventional refinery may further include providing the demetallized vacuum gas oil stream 105 to one or more of a vacuum gas oil hydrotreating unit 26, a hydrocracking unit 30, and a residue hydroprocessing unit 46 provided in the conventional refinery.

In one or more embodiments, integration with the conventional refinery may further include providing the vacuum gas oil fraction 104 from the first fractionator 152 directly to one or more of a delayed coking unit 40, a gasification unit 42, and a solvent desphalting unit 44 provided in the conventional refinery without preprocessing in the demetallization operation 153.

EXAMPLES

The following examples illustrate features of the present disclosure but are not intended to limit the scope of the disclosure.

To demonstrate the utility of the methods of producing pyrolysis products from a mixed plastics stream in accordance with the present disclosure representative testing was completed. Specifically, a conventional refinery as operated with and without the system for processing mixed plastics into plastic pyrolysis products as disclosed in the present disclosure.

Comparative Example 1

Figure 4:
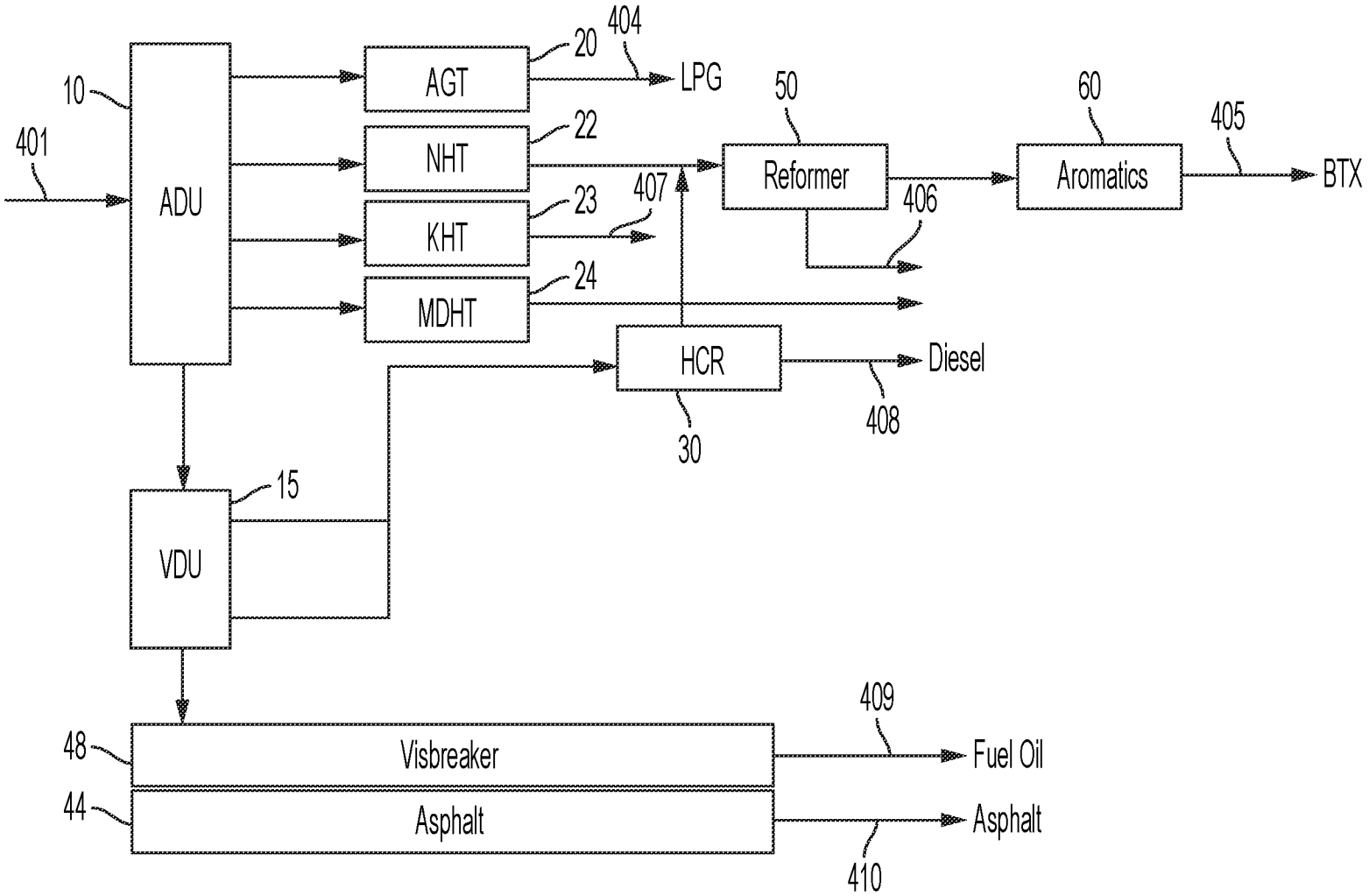
FIG. 4 is a schematic illustration of a refinery as assembled for Comparative Example 1.

A 100 thousand barrels per day (MBPSD) refinery of the configuration shown in FIG. 4 processed Arab heavy and Arab light crude oil to produce fuels and aromatics. The products and their yields are shown in Table 10 provided infra. As detailed in Table 10, the conventional refinery produces yields of 5.3 MBPSD of liquid propane gas (LPG), 5.8 MBPSD of benzene, toluene, xylenes (BTX), 27.5 MBPSD of gasoline, 2.7 MBPSD of Jet, 40.0 MBPSD of diesel, 4.4 MBPSD of fuel oil, and 15.3 MPSD of asphalt.

As the various unit operations present within the exemplary conventional refinery are known to one skilled in the art and operated according to the same specifications between Comparative Example 1 and Inventive Example 2, nuanced detail of each is not provided. Instead each unit operation and the streams passed between the various unit operations are simply noted in accordance with the following tables.

TABLE 4

Figure 5:
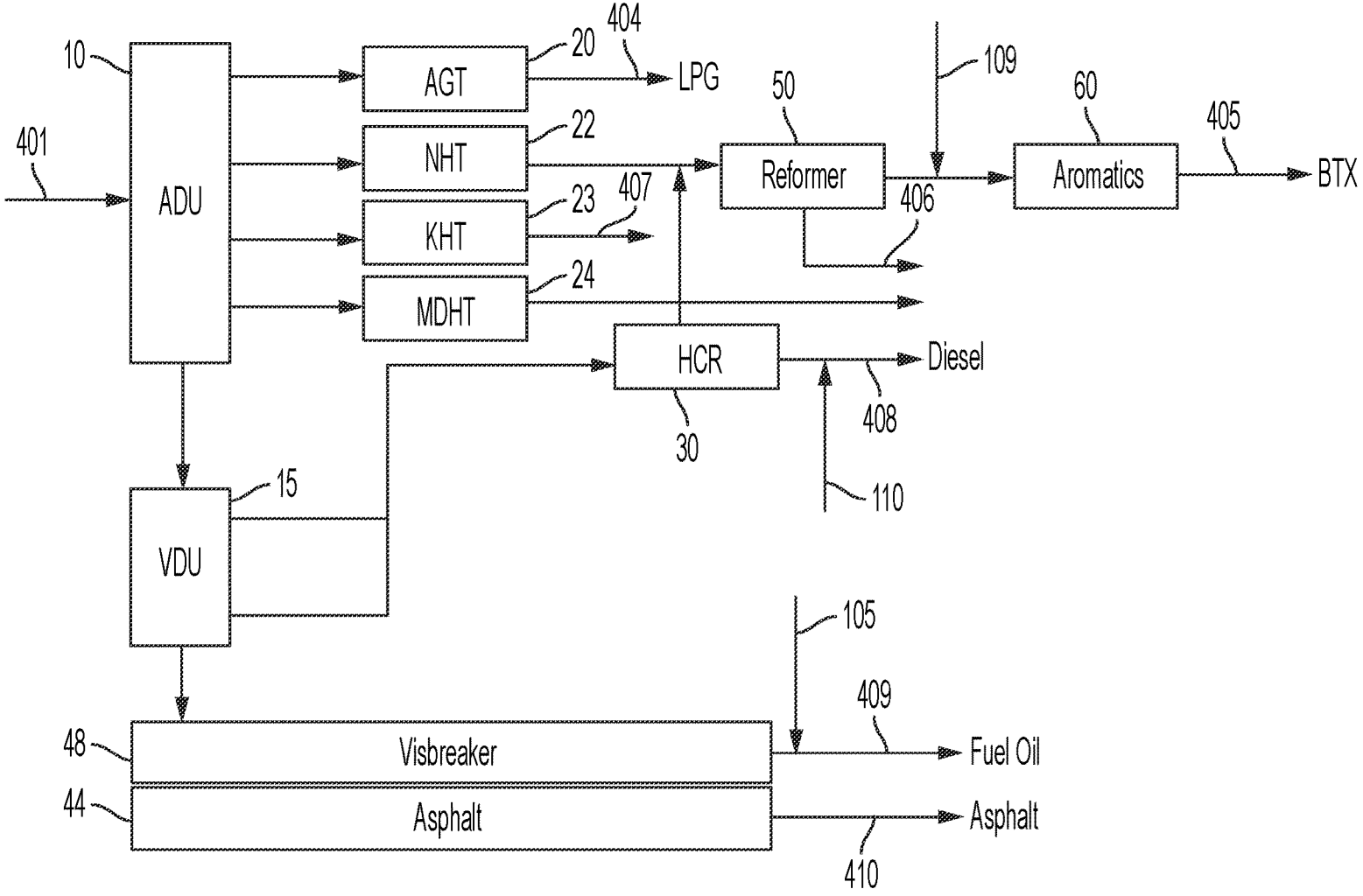
FIG. 5 is a schematic illustration of a refinery incorporating the system of FIG. 1 as assembled for Inventive Example 2.

| Conventional Refinery Vessels—FIGS. 4 and 5 | |
|---|---|
| 10 | Atmospheric distillation unit (ADU) |
| 15 | Vacuum distillation unit (VDU) |
| 20 | Acid gas treatment unit (AGT) |
| 22 | Naphtha hydrotreating unit (NHT) |
| 23 | Kerosene hydrotreating unit (KHT) |
| 24 | Mid-distillate hydrotreating unit (MDHT) |
| 44 | Solvent deasphalting unit |
| 48 | Visbreaker unit |
| 50 | Reformer |
| 60 | Aromatic recovery unit |

TABLE 5

| Conventional Refinery Process Streams—FIGS. 4 and 5 | |
|---|---|
| 401 | Crude Oil |
| 404 | LPG |
| 405 | BTX |
| 406 | Gasoline |
| 407 | Jet |
| 408 | Diesel |
| 409 | Fuel Oil |
| 410 | Asphalt |

Inventive Example 2

A plastic pyrolysis unit with 5% of the total crude oil capacity of the conventional refinery was added to the conventional refinery. Specifically, a system for processing mixed plastics into plastic pyrolysis products in accordance to the present disclosure was operated to generate feeds for integration with the conventional refinery. That is a hydrotreated plastic pyrolysis naphtha stream 109, a hydrotreated plastic pyrolysis diesel stream 110, and a demetallized vacuum gas oil stream 105, in accordance with the present disclosure were generated and provided to the conventional refinery. Such arrangement is illustrated in FIG. 5.

A plastic feed comprising a mixture of HDPE, LDPE, PP, LLDPE, PS, and PET was provided to the plastic pyrolysis unit 151 and processed to generate a stream of plastic pyrolysis oil 102. The properties and composition of the plastic pyrolysis oil 102 are shown in Table 6. Further, the plastic pyrolysis oil 102 is provided to a first fractionator 152 in accordance with the present disclosure and separated into the distillate fraction 103 including naphtha and diesel boiling in the range of 36 to 370° C. and a vacuum gas oil fraction 104 including hydrocarbons boiling at 370° C. or greater. The breakdown of naphtha, diesel, and vacuum gas oil are also provided in Table 6.

TABLE 6

| Vacuum Gas Oil Fraction Composition | | |
|---|---|---|
| Property/Composition | Unit | Value |
| Density | $kg/m^3$ | 790 |
| Chlorine | ppmw | 130 |
| Nitrogen | ppmw | 1139 |
| Sulfur | ppmw | 82 |
| Oxygen | ppmw | 1562 |
| Metals | ppmw | 65 |
| Di-olefins | W % | 19.6 |
| Mono-Olefins | W % | 9.4 |
| Naphtha (36-180° C.) | W % | 30.6 |
| Diesel (180 370° C.) | W % | 59.0 |
| VGO (370° C.) | W % | 10.4 |

After pyrolysis and separation, di-olefins, mono-olefins, sulfur and nitrogen are removed from the distillate fraction 103 (naphtha and diesel) to generate clean plastic pyrolysis distillate 108. The operating conditions for di-olefin, mono-olefin and sulfur removal steps are given in Tables 7-9. A Ni—Mo/Alumina catalyst was used in all steps.

TABLE 7

Di-Olefin Removal Reactor Operating Conditions

| Parameter | unit | value |
|---|---|---|
| Temperature | ° C. | 175 |
| Hydrogen Pressure inlet | Bar | 17 |
| WHSV | $h^{-1}$ | 2 |
| Hydrogen recycle rate | $Sm^3/m^3$ | 75 |

TABLE 8

Olefin Removal Reactor Operating Conditions

| parameter | unit | value |
|---|---|---|
| Temperature | ° C. | 300 |
| Hydrogen Pressure inlet | Bar | 17 |
| WHSV | $h^{-1}$ | 1.5 |
| Hydrogen recycle rate | $Sm^3/m^3$ | 425 |

TABLE 9

Hydrodesulfurization Reactor Operating Conditions

| parameter | unit | value |
|---|---|---|
| Temperature | ° C. | 330 |
| Hydrogen Pressure inlet | Bar | 17 |
| WHSV | $h^{-1}$ | 6 |
| Hydrogen recycle rate | $Sm^3/m^3$ | 200 |

Finally, the clean plastic pyrolysis distillate was fractionated in a second fractionator 157 to generate the hydrotreated plastic pyrolysis naphtha stream 109 and the hydrotreated plastic pyrolysis diesel stream 110. As illustrated in FIG. 5, the hydrotreated plastic pyrolysis naphtha stream 109 was sent to aromatics recovery unit 30, the hydrotreated plastic pyrolysis diesel stream 110 was sent to the diesel pool, and the demetallized vacuum gas oil stream 105 was sent to the fuel pool. The refinery products and their yields are shown in Table 10. As detailed in Table 10, upon integration of the plastic pyrolysis system into the conventional refinery, the resulting expanded refinery produces yields of 8.0 MBPSD of LGP, 6.2 MBPSD of BTX, 27.9 MBPSD of gasoline, 2.7 MBPSD of Jet, 41.6 MBPSD of diesel, 4.4 MBPSD of fuel oil, and 15.6 MPSD of asphalt. This represents a BTX yield increase of 0.4 MPSD to 6.2 MBPSD and a diesel yield increase by 1.6 MBPSD to 41.6 MBPSD. Slight increases are also observed in gasoline and fuel oil yields.

TABLE 10

Products from Comparative Example 1 and Inventive Example 2

| Stream# | Stream Name | Example 2 Conventional Refinery Flow, MBPSD | Example 3 Conventional Refinery with Plastic Recycling Flow, MBPSD |
|---|---|---|---|
| 401 | Crude Oil | 100 | 100 |
| 101 | Plastic (solid) | | 5.0 |
| 102 | Plastic pyrolysis oil | | 2.7 |
| 404 | LPG | 5.8 | 6.2 |
| 405 | BTX | 27.5 | 27.9 |
| 406 | Gasoline | 2.7 | 3.2 |
| 407 | Jet | 40.0 | 41.6 |

TABLE 10-continued

Products from Comparative Example 1 and Inventive Example 2

| Stream# | Stream Name | Example 2 Conventional Refinery Flow, MBPSD | Example 3 Conventional Refinery with Plastic Recycling Flow, MBPSD |
|---|---|---|---|
| 408 | Diesel | 4.4 | 5.3 |
| 409 | Fuel Oil | 15.3 | 15.6 |
| 410 | Asphalt | 2.8 | 2.9 |

It should now be understood the various aspects of the method of producing pyrolysis products from a mixed plastics stream and associated system for processing mixed plastics into plastic pyrolysis products are described and such aspects may be utilized in conjunction with various other aspects.

According to a first aspect, a method of producing pyrolysis products from a mixed plastics stream includes (a) conducting pyrolysis of a plastic feedstock to produce a stream of plastic pyrolysis oil; (b) feeding the plastic pyrolysis oil to a first fractionator to separate the plastic pyrolysis oil into a distillate fraction including naphtha and diesel boiling in the range of 36 to 370° C. and a vacuum gas oil fraction comprising hydrocarbons boiling above 370° C.; and (c) feeding the distillate fraction to a three step hydrotreating operation. The three step hydrotreating operation includes feeding the distillate fraction to a first hydrotreating unit configured and operated to remove di-olefins by hydrogenation from the distillate fraction to produce a first product stream of dediolefinized plastic pyrolysis distillate, feeding the first product stream to a second hydrotreating unit configured and operated to remove mono-olefins by hydrogenation from the first product stream to produce a second product stream of deolefinized plastic pyrolysis distillate, and feeding the second product stream to a third hydrotreating unit configured and operated to remove sulfur and nitrogen by hydrodesulfurization and hydrodenitrogenation from the second product stream to produce a third product stream of clean plastic pyrolysis distillate.

A second aspect includes the method of the first aspect in which the first fractionator further separates the distillate fraction into a plastic pyrolysis distillate naphtha stream and a plastic pyrolysis distillate diesel stream.

A third aspect includes the method of the second aspect in which the plastic pyrolysis distillate naphtha stream comprises hydrocarbons boiling in the range of 36 to 180° C. and the plastic pyrolysis distillate diesel stream comprises hydrocarbons boiling in the range of 180 to 370° C.

A fourth aspect includes the method of the second or third aspect in which the first hydrotreating unit is split into a first naphtha hydrotreating unit and a first diesel hydrotreating unit, the second hydrotreating unit is split into a second naphtha hydrotreating unit and a second diesel hydrotreating unit, and the third hydrotreating unit is split into a third naphtha hydrotreating unit and a third diesel hydrotreating unit such that the three step hydrotreating operation is split into a plastic pyrolysis distillate naphtha hydrotreating operation and a plastic pyrolysis distillate diesel hydrotreating operation. The plastic pyrolysis distillate naphtha hydrotreating operation includes feeding the plastic pyrolysis distillate naphtha stream to the first naphtha hydrotreating unit configured and operated to remove di-olefins by hydrogenation from the plastic pyrolysis distillate naphtha stream to produce a first naphtha product stream of dediolefinized plastic pyrolysis distillate naphtha, feeding the first naphtha product stream to the second naphtha hydrotreating unit configured and operated to remove mono-olefins by hydrogenation from the first naphtha product stream to produce a second naphtha product stream of deolefinized plastic pyrolysis distillate naphtha, and feeding the second naphtha product stream to the third naphtha hydrotreating unit configured and operated to remove sulfur and nitrogen by hydrodesulfurization and hydrodenitrogenation from the second naphtha product stream to produce a third naphtha product stream of clean plastic pyrolysis distillate naphtha. The plastic pyrolysis distillate diesel hydrotreating operation includes feeding the plastic pyrolysis distillate diesel fraction to the first diesel hydrotreating unit configured and operated to remove di-olefins by hydrogenation from the plastic pyrolysis distillate diesel stream to produce a first diesel product stream of dediolefinized plastic pyrolysis distillate diesel, feeding the first diesel product stream to the second hydrotreating unit configured and operated to remove mono-olefins by hydrogenation from the first diesel product stream to produce a second diesel product stream of deolefinized plastic pyrolysis distillate diesel, and feeding the second diesel product stream to the third diesel hydrotreating unit configured and operated to remove sulfur and nitrogen by hydrodesulfurization and hydrodenitrogenation from the second diesel product stream to produce a third diesel product stream of clean plastic pyrolysis distillate diesel.

A fifth aspect includes the method of any of the first through fourth aspects in which the plastic feedstock comprises mixed plastics of differing compositions.

A sixth aspect includes the method of any of the first through fifth aspects in which the plastic feedstock comprises two or more plastics selected from olefins, carbonates, aromatic polymers, sulfones, fluorinated hydrocarbon polymers, chlorinated hydrocarbon polymers, and acrylonitriles or two or more plastics selected from HDPE, LDPE, PP, LLDPE, PS, and PET.

A seventh aspect includes the method of any of the first through sixth aspects in which the method further comprises feeding the vacuum gas oil fraction comprising hydrocarbons boiling above 370° C. to a demetallization operation to remove metallic constituents from the vacuum gas oil fraction and generate a demetallized vacuum gas oil stream.

An eighth aspect includes the method of any of the first through seventh aspects in which where the first hydrotreating unit includes a first hydrogenation catalyst, the first hydrogenation catalyst comprising a nickel catalyst on one or more of an alumina support, a silica support, and a titania support.

A ninth aspect includes the method of any of the second through eighth aspects in which the second hydrotreating unit includes a second hydrogenation catalyst, the second hydrogenation catalyst comprising a nickel catalyst on one or more of an alumina support, a silica support, and a titania support.

A tenth aspect includes the method of any of the first through ninth aspects in which the third hydrotreating unit includes a third hydrotreating catalyst, the third hydrotreating catalyst comprising a catalyst comprising one or more of Cobalt, Nickel, and Molybdenum singly or in combination on one or more of an alumina support, a silica support, and a titania support.

An eleventh aspect includes the method of any of the first through tenth aspects in which the first hydrotreating unit is operated at a temperature of 150 to 210° C.

A twelfth aspect includes the method of any of the first through eleventh aspects in which the second hydrotreating unit is operated at a temperature of 250 to 330° C.

A thirteenth aspect includes the method of any of the first through twelfth aspects in which the third hydrotreating unit is operated at a temperature of 330 to 420° C.

A fourteenth aspect includes the method of any of the first and fifth through thirteenth aspects in which the third product stream is further provided to a second fractionator to generate a hydrotreated plastic pyrolysis naphtha stream and a hydrotreated plastic pyrolysis diesel stream based on fractionation at a hydrocarbon boiling point of 160 to 220° C.

A fifteenth aspect includes the method of the fourteenth aspect in which the method further comprises integration with a conventional refinery such that the hydrotreated plastic pyrolysis naphtha stream is directly provided to an aromatic recovery unit, the hydrotreated plastic pyrolysis diesel stream is combined with a diesel output stream from the conventional refinery, or the hydrotreated plastic pyrolysis naphtha stream is directly provided to an aromatic recovery unit and the hydrotreated plastic pyrolysis diesel stream is combined with a diesel output stream from the conventional refinery.

A sixteenth aspect includes the method of the fifteenth aspect in which the method further includes feeding the vacuum gas oil fraction to a demetallization operation to remove metallic constituents from the vacuum gas oil fraction and generate a demetallized vacuum gas oil stream; and the integration with a conventional refinery further includes providing the demetallized vacuum gas oil stream to one or more of a vacuum gas oil hydrotreating unit, a hydrocracking unit, and a residue hydroprocessing unit provided in the conventional refinery.

A seventeenth aspect includes the method of the fifteenth aspect in which the integration with a conventional refinery further includes providing the vacuum gas oil fraction from the first fractionator to one or more of a delayed coking unit, a gasification unit, and a solvent desphalting unit provided in the conventional refinery.

An eighteenth aspect includes the method of the fourth through twelfth aspects in which the method further comprises integration with a conventional refinery such that the third naphtha product stream is directly provided to an aromatic recovery unit, the a third diesel product stream is combined with a diesel output stream from the conventional refinery, or the third naphtha product stream is directly provided to an aromatic recovery unit and the third diesel product stream is combined with a diesel output stream from the conventional refinery.

A nineteenth aspect includes the method of eighteenth aspect in which the method further includes feeding the vacuum gas oil fraction to a demetallization operation to remove metallic constituents from the vacuum gas oil fraction and generate a demetallized vacuum gas oil stream; and the integration with a conventional refinery further includes providing the demetallized vacuum gas oil stream to one or more of a vacuum gas oil hydrotreating unit, a hydrocracking unit, and a residue hydroprocessing unit provided in the conventional refinery.

A twentieth aspect includes the method of the eighteenth aspect in which the integration with a conventional refinery further includes providing the vacuum gas oil fraction from the first fractionator to one or more of a delayed coking unit, a gasification unit, and a solvent desphalting unit provided in the conventional refinery.

A twenty-first aspect includes the method of any of the first through twentieth aspects in which the pyrolysis of a plastic feedstock is performed in the presence of a catalyst at a temperature of 300 to 1000° C.

According to a twenty-second aspect a system for processing mixed plastics into plastic pyrolysis products includes an inlet stream comprising mixed plastics; a plastic pyrolysis unit, the plastic pyrolysis unit in fluid communication with the inlet stream, and operable generate a stream of plastic pyrolysis oil from the inlet stream; a first fractionator, the first fractionator in fluid communication with the plastic pyrolysis unit and operable to separate the stream of plastic pyrolysis oil into a distillate fraction including naphtha and diesel boiling in the range of 36 to 370° C. and a vacuum gas oil fraction comprising hydrocarbons boiling above 370° C.; a first hydrotreating unit, the first hydrotreating unit in fluid communication with the first fractionator and operable to remove di-olefins by hydrogenation from the distillate fraction provided from the first fractionator to produce a first product stream of dediolefinized plastic pyrolysis distillate; a second hydrotreating unit, the second hydrotreating unit in fluid communication with the first hydrotreating unit and operable to remove mono-olefins by hydrogenation from the first product stream provided from the first hydrotreating unit to produce a second product stream of deolefinized plastic pyrolysis distillate; and a third hydrotreating unit, the third hydrotreating unit in fluid communication with the second hydrotreating unit and operable to remove sulfur and nitrogen by hydrodesulfurization and hydrodenitrogenation from the second product stream provided from the second hydrotreating unit to produce a third product stream of clean plastic pyrolysis distillate.

A twenty-third aspect includes the system of the twenty-second aspect in which where the first fractionator is further operable to separate the distillate fraction into a plastic pyrolysis distillate naphtha stream comprising hydrocarbons boiling in the range of 36 to 180° C. and a plastic pyrolysis distillate diesel stream comprising hydrocarbons boiling in the range of 180 to 370° C.

A twenty-fourth aspect includes the system of the twenty-third aspect in which the first hydrotreating unit is split into a first naphtha hydrotreating unit and a first diesel hydrotreating unit, the second hydrotreating unit is split into a second naphtha hydrotreating unit and a second diesel hydrotreating unit, and the third hydrotreating unit is split into a third naphtha hydrotreating unit and a third diesel hydrotreating unit. Further, the first naphtha hydrotreating unit is in fluid communication with the first fractionator and operable to remove di-olefins by hydrogenation from the plastic pyrolysis distillate naphtha stream provided from the first fractionator to produce a first naphtha product stream of dediolefinized plastic pyrolysis distillate naphtha; the second naphtha hydrotreating unit is in fluid communication with the first naphtha hydrotreating unit and operable to remove mono-olefins by hydrogenation from the first naphtha product stream provided from the first naphtha hydrotreating unit to produce a second naphtha product stream of deolefinized plastic pyrolysis distillate naphtha; and the third naphtha hydrotreating unit is in fluid communication with the second naphtha hydrotreating unit and operable to remove sulfur and nitrogen by hydrodesulfurization and hydrodenitrogenation from the second naphtha product stream provided from the second naphtha hydrotreating unit to produce a third naphtha product stream of clean plastic pyrolysis distillate naphtha. Additionally, the first diesel hydrotreating unit is in fluid communication with the first fractionator and operable to remove di-olefins by hydrogenation from the plastic pyrolysis distillate diesel stream provided from the first fractionator to produce a first diesel product stream of dediolefinized plastic pyrolysis distillate diesel; the second diesel hydrotreating unit is in fluid communication with the first diesel hydrotreating unit and operable to remove mono-olefins by hydrogenation from the first diesel product stream provided from the first diesel hydrotreating unit to produce a second diesel product stream of deolefinized plastic pyrolysis distillate diesel; and the third diesel hydrotreating unit is in fluid communication with the second diesel hydrotreating unit and operable to remove sulfur and nitrogen by hydrodesulfurization and hydrodenitrogenation from the second diesel product stream provided from the second diesel hydrotreating unit to produce a third diesel product stream of clean plastic pyrolysis distillate diesel.

A twenty-fifth aspect includes the system of any of the twenty-second aspect in which where the system further comprises a second fractionator, the second fractionator in fluid communication with the third hydrotreating unit and operable to separate the third product stream of clean plastic pyrolysis distillate to a hydrotreated plastic pyrolysis naphtha stream and a hydrotreated plastic pyrolysis diesel stream based on fractionation at a hydrocarbon boiling point of 160 to 220° C.

A twenty-sixth aspect includes the system of any of the twenty-second through twenty-fifth aspects in which the system further comprises a demetallization reactor, the demetallization reactor in fluid communication with the first fractionator and operable to remove metallic constituents from the vacuum gas oil fraction and generate a demetallized vacuum gas oil stream.

It should be apparent to those skilled in the art that various modifications and variations can be made to the described embodiments without departing from the spirit and scope of the claimed subject matter. Thus, it is intended that the specification cover the modifications and variations of the various described embodiments provided such modifications and variations come within the scope of the appended claims and their equivalents.

The singular forms "a", "an" and "the" include plural referents, unless the context clearly dictates otherwise.

Throughout this disclosure ranges are provided. It is envisioned that each discrete value encompassed by the ranges are also included. Additionally, the ranges which may be formed by each discrete value encompassed by the explicitly disclosed ranges are equally envisioned. For brevity, the same is not explicitly indicated subsequent to each disclosed range and the present general indication is provided.

As used in this disclosure and in the appended claims, the words "comprise," "has," and "include" and all grammatical variations thereof are each intended to have an open, non-limiting meaning that does not exclude additional elements or steps.

What is claimed is:

1. A method of producing pyrolysis products from a mixed plastics stream, the method comprising:

(a) conducting pyrolysis of a plastic feedstock to produce a stream of plastic pyrolysis oil;

(b) feeding the plastic pyrolysis oil to a first fractionator to separate the plastic pyrolysis oil into a distillate fraction including naphtha and diesel boiling in the range of 36 to 370° C. and a vacuum gas oil fraction comprising hydrocarbons boiling above 370° C.; and (c) feeding the distillate fraction to a three step hydrotreating operation, the three step hydrotreating operation comprising:

i. feeding the distillate fraction comprising naphtha and diesel boiling in the range of 36 to 370° C. to a first hydrotreating unit configured and operated to remove di-olefins by hydrogenation from the distillate fraction to produce a first product stream of dediolefinized plastic pyrolysis distillate representing all the effluent from the first hydrotreating unit, wherein the first hydrotreating unit is operated at a temperature of 150 to 210° C. and the first product stream of dediolefinized plastic pyrolysis distillate comprises less than 1 wt. % di-olefins;

ii. feeding the first product stream directly and entirely and without additional hydrocarbons to a second hydrotreating unit configured and operated to remove mono-olefins by hydrogenation from the first product stream to produce a second product stream of deolefinized plastic pyrolysis distillate, wherein the second hydrotreating unit is operated at a temperature of 300 to 330° C. and the second product stream of deolefinized plastic pyrolysis distillate comprises less than 1 wt. % olefins; and iii. feeding the second product stream to a third hydrotreating unit configured and operated to remove sulfur by hydrodesulfurization and nitrogen by hydrodenitrogenation from the second product stream to produce a third product stream of clean plastic pyrolysis distillate, wherein the third hydrotreating unit is operated at a temperature of 330 to 420° C.

2. The method of claim 1, where the first fractionator further separates the distillate fraction into a plastic pyrolysis distillate naphtha stream and a plastic pyrolysis distillate diesel stream.

3. The method of claim 2, where the plastic pyrolysis distillate naphtha stream comprises hydrocarbons boiling in the range of 36 to 180° C. and the plastic pyrolysis distillate diesel stream comprises hydrocarbons boiling in the range of 180 to 370° C.

4. The method of claim 2, where the first hydrotreating unit is split into a first naphtha hydrotreating unit and a first diesel hydrotreating unit, the second hydrotreating unit is split into a second naphtha hydrotreating unit and a second diesel hydrotreating unit, and the third hydrotreating unit is split into a third naphtha hydrotreating unit and a third diesel hydrotreating unit such that the three step hydrotreating operation is split into a plastic pyrolysis distillate naphtha hydrotreating operation and a plastic pyrolysis distillate diesel hydrotreating operation, where the plastic pyrolysis distillate naphtha hydrotreating operation comprises:

i. feeding the plastic pyrolysis distillate naphtha stream to the first naphtha hydrotreating unit configured and operated to remove di-olefins by hydrogenation from the plastic pyrolysis distillate naphtha stream to produce a first naphtha product stream of dediolefinized plastic pyrolysis distillate naphtha representing all the effluent from the first naphtha hydrotreating unit, wherein the first naphtha hydrotreating unit is operated at a temperature of 150 to 210° C. and the first naphtha product stream of dediolefinized plastic pyrolysis distillate naphtha comprises less than 1 wt. % di-olefins;

ii. feeding the first naphtha product stream directly and entirely and without additional hydrocarbons to the second naphtha hydrotreating unit configured and operated to remove mono-olefins by hydrogenation from the first naphtha product stream to produce a second naphtha product stream of deolefinized plastic pyrolysis distillate naphtha, wherein the second naphtha hydrotreating unit is operated at a temperature of 300 to 330° C. and the second naphtha product stream of deolefinized plastic pyrolysis distillate naphtha comprises less than 1 wt. % olefins; and iii. feeding the second naphtha product stream to the third naphtha hydrotreating unit configured and operated to remove sulfur by hydrodesulfurization and nitrogen by hydrodenitrogenation from the second naphtha product stream to produce a third naphtha product stream of clean plastic pyrolysis distillate naphtha, wherein the third naphtha hydrotreating unit is operated at a temperature of 330 to 420° C.; and the plastic pyrolysis distillate diesel hydrotreating operation comprises:

i. feeding the plastic pyrolysis distillate diesel fraction to the first diesel hydrotreating unit configured and operated to remove di-olefins by hydrogenation from the plastic pyrolysis distillate diesel stream to produce a first diesel product stream of dediolefinized plastic pyrolysis distillate diesel representing all the effluent from the first diesel hydrotreating unit, wherein the first diesel hydrotreating unit is operated at a temperature of 150 to 210° C. and the first diesel product stream of dediolefinized plastic pyrolysis distillate diesel comprises less than 1 wt. % di-olefins;

ii. feeding the first diesel product stream directly and entirely and without additional hydrocarbons to the second hydrotreating unit configured and operated to remove mono-olefins by hydrogenation from the first diesel product stream to produce a second diesel product stream of deolefinized plastic pyrolysis distillate diesel, wherein the second diesel hydrotreating unit is operated at a temperature of 300 to 330° C. and the second diesel product stream of deolefinized plastic pyrolysis distillate diesel comprises less than 1 wt. % olefins; and iii. feeding the second diesel product stream to the third diesel hydrotreating unit configured and operated to remove sulfur by hydrodesulfurization and nitrogen by hydrodenitrogenation from the second diesel product stream to produce a third diesel product stream of clean plastic pyrolysis distillate diesel, wherein the third diesel hydrotreating unit is operated at a temperature of 330 to 420° C.

5. The method of claim 1, where the plastic feedstock comprises mixed plastics of differing compositions.

6. The method of claim 1, where the method further comprises feeding the vacuum gas oil fraction comprising hydrocarbons boiling above 370° C. to a demetallization operation to remove metallic constituents from the vacuum gas oil fraction and generate a demetallized vacuum gas oil stream.

7. The method of claim 1, where the first hydrotreating unit includes a first hydrogenation catalyst, the first hydrogenation catalyst comprising a nickel catalyst on one or more of an alumina support, a silica support, and a titania support.

8. The method of claim 1, where the second hydrotreating unit includes a second hydrogenation catalyst, the second hydrogenation catalyst comprising a nickel catalyst on one or more of an alumina support, a silica support, and a titania support.

9. The method of claim 1, where the third hydrotreating unit includes a third hydrotreating catalyst, the third hydrotreating catalyst comprising a catalyst comprising one or more of Cobalt, Nickel, and Molybdenum singly or in combination on one or more of an alumina support, a silica support, and a titania support.

10. The method of claim 1, where the third product stream is further provided to a second fractionator to generate a hydrotreated plastic pyrolysis naphtha stream and a hydrotreated plastic pyrolysis diesel stream based on fractionation at a hydrocarbon boiling point of 160 to 220° C.

11. The method of claim 10, where the method further comprises integration with a conventional refinery such that the hydrotreated plastic pyrolysis naphtha stream is directly provided to an aromatic recovery unit, the hydrotreated plastic pyrolysis diesel stream is combined with a diesel output stream from the conventional refinery, or the hydrotreated plastic pyrolysis naphtha stream is directly provided to an aromatic recovery unit and the hydrotreated plastic pyrolysis diesel stream is combined with a diesel output stream from the conventional refinery.

12. The method of claim 11, where the method further comprises:

feeding the vacuum gas oil fraction to a demetallization operation to remove metallic constituents from the vacuum gas oil fraction and generate a demetallized vacuum gas oil stream; and the integration with a conventional refinery further includes providing the demetallized vacuum gas oil stream to one or more of a vacuum gas oil hydrotreating unit, a hydrocracking unit, and a residue hydroprocessing unit provided in the conventional refinery.

13. The method of claim 11, where the integration with a conventional refinery further includes providing the vacuum gas oil fraction from the first fractionator to one or more of a delayed coking unit, a gasification unit, and a solvent desphalting unit provided in the conventional refinery.

14. The method of claim 4, where the method further comprises integration with a conventional refinery such that the third naphtha product stream is directly provided to an aromatic recovery unit, the a third diesel product stream is combined with a diesel output stream from the conventional refinery, or the third naphtha product stream is directly provided to an aromatic recovery unit and the third diesel product stream is combined with a diesel output stream from the conventional refinery.

15. The method of claim 14, where the method further comprises:

feeding the vacuum gas oil fraction to a demetallization operation to remove metallic constituents from the vacuum gas oil fraction and generate a demetallized vacuum gas oil stream; and the integration with a conventional refinery further includes providing the demetallized vacuum gas oil stream to one or more of a vacuum gas oil hydrotreating unit, a hydrocracking unit, and a residue hydroprocessing unit provided in the conventional refinery.

16. The method of claim 14, where the integration with a conventional refinery further includes providing the vacuum gas oil fraction from the first fractionator to one or more of a delayed coking unit, a gasification unit, and a solvent desphalting unit provided in the conventional refinery.

17. The method of claim 1, where the pyrolysis of a plastic feedstock is performed in the presence of a catalyst at a temperature of 300° C. to 1000° C.

18. The method of claim 1, where the first product stream of dediolefinized plastic pyrolysis distillate comprises less than 0.01 wt. % di-olefins and the second product stream of deolefinized plastic pyrolysis distillate comprises less than 0.01 wt. % olefins.

19. The method of claim 4, where the first naphtha product stream of dediolefinized plastic pyrolysis distillate naphtha comprises less than 0.01 wt. % di-olefins, the second naphtha product stream of deolefinized plastic pyrolysis distillate naphtha comprises less than 0.01 wt. % olefins, the first diesel product stream of dediolefinized plastic pyrolysis distillate diesel comprises less than 0.01 wt. % di-olefins, and the second diesel product stream of deolefinized plastic pyrolysis distillate diesel comprises less than 0.01 wt. % olefins.

* * * * *